US006128458A

United States Patent [19]

Sato

[11] Patent Number: 6,128,458

[45] **Date of Patent: *Oct. 3, 2000**

[54] IMAGE FORMING DEVICE WITH TONER CHARGE INCREASING STRUCTURE

[75] Inventor: Shougo Sato, Seto, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/126,589

[22] Filed: Jul. 31, 1998

Related U.S. Application Data

[63] Continuation-in-part of application No. 08/759,225, Dec. 5, 1996, Pat. No. 5,867,755.

[30] Foreign Application Priority Data

| | | | |
|---|---|---|---|
| Jul. 31, 1997 | [JP] | Japan | 9-206315 |
| Jul. 31, 1997 | [JP] | Japan | 9-206316 |
| Jul. 31, 1997 | [JP] | Japan | 9-206317 |
| Jul. 31, 1997 | [JP] | Japan | 9-206318 |
| Jul. 31, 1997 | [JP] | Japan | 9-206319 |
| Sep. 18, 1997 | [JP] | Japan | 9-253292 |

[51] Int. Cl.[7] ..... G03G 15/08

[52] U.S. Cl. ..... 399/252; 430/101

[58] Field of Search ..... 430/101; 399/252, 399/259, 279

[56] References Cited

U.S. PATENT DOCUMENTS

| | | | |
|---|---|---|---|
| 5,170,213 | 12/1992 | Yamaguchi et al. . | |
| 5,473,417 | 12/1995 | Hirano | 399/285 |
| 5,585,895 | 12/1996 | Yashiro et al. | 399/103 |
| 5,716,748 | 2/1998 | Hasegawa et al. | 430/110 |
| 5,783,347 | 7/1998 | Ikami | 430/110 |
| 5,867,755 | 2/1999 | Sato | 399/149 |
| 5,878,313 | 3/1999 | Takagi et al. | 399/279 |

FOREIGN PATENT DOCUMENTS

| | | |
|---|---|---|
| 0 778 506 A1 | 11/1997 | European Pat. Off. . |
| 9-160370 | 6/1997 | Japan . |
| 9-160372 | 6/1997 | Japan . |
| 9-160379 | 6/1997 | Japan . |
| 9-185255 | 7/1997 | Japan . |
| 9-218572 | 8/1997 | Japan . |

OTHER PUBLICATIONS

Arthur S. Diamond, Handbook of Imaging Materials, Marcel Dekker, Inc., New York, 1991, pp. 163–170.

*Primary Examiner*—Sandra Brase
*Assistant Examiner*—Greg Moldafsky
*Attorney, Agent, or Firm*—Oliff & Berridge, PLC

[57] ABSTRACT

A printer includes a developing roller and a positively charged photosensitive drum. The printer performs impression development by pressing positively charged toner at a nip portion between the photosensitive drum and the developing roller. A developing agent is formed from toner and a charge controlling agent so that a charge amount Q1 of toner on the developing roller before the toner passes through the nip portion is less than the charge amount of toner after the toner passes through the nip portion.

38 Claims, 10 Drawing Sheets

IMAGE FORMING DEVICE WITH TONER CHARGE INCREASING STRUCTURE

This is a continuation-in-part of application Ser. No. 08/759,225 filed Dec. 5, 1996, now issued as U.S. Pat. No. 5,867,755. The disclosure of the prior application is hereby incorporated by reference herein in its entirety.

BACKGROUND OF THE INVENTION

1. Field of the Invention

The present invention relates to an electrophotographic image forming device, such as a laser beam printer, a facsimile machine, and a copy machine. The present invention particularly relates to an image forming device that develops an electrostatic latent image on a photosensitive drum using toner transported by a developing roller to a nip portion between the photosensitive drum and the developing roller.

2. Description of the Related Art

Impression development is widely used as a developing method in electrophotographic image forming devices. Impression development uses a roller, which is formed from an electrically conductive and resilient material, as a developing roller for carrying toner. The developing roller is pressed against the photosensitive drum to perform development.

A corona charge device is provided for charging the entire surface of the photosensitive drum. An exposure means is provided for selectively exposing the charged surface of the photosensitive drum to form an electrostatic latent image on the surface of the photosensitive drum. A predetermined developing electric field is developed between the developing roller and the photosensitive drum. Therefore, when toner born on the surface of the developing roller contacts the surface of the photosensitive drum, toner born on the developing roller moves toward and develops the electrostatic latent image.

Either positively charged toner or negatively charged toner can be used in impression development. Conventionally, negatively charged toner is mainly used because of stability in its charge characteristic.

Printers that expose images using a laser beam, for example, use what is called reverse development to form toner images, wherein the polarity of charge on the photosensitive drum matches the polarity of charge of the toner. Therefore, when the toner used in development has a negative polarity, the photosensitive drum must also be charged with a negative polarity. Accordingly, the polarity of voltage discharged by the corona charge unit must have a negative polarity.

However, when a corona charge unit is used to charge the surface of the photosensitive drum, the corona charge unit ionizes atmospheric oxygen molecules ($O_2$) so that ozone ($O_3$) is generated. This is particularly the case, when the corona charge unit discharges a negative polarity charge, wherein the amount of ozone generated can be ten times greater or so than when the corona charge unit discharges a positive polarity charge. This is undesirable from an environmental view point.

To overcome this problem, it is conceivable to use a positively charging toner in a printer. Such a printer can use a corona charge unit that discharges voltage having a positive polarity so that the amount of ozone generated can be reduced However, it is impossible to completely remove the electric potential from the surface of the photosensitive drum of this printer. Therefore, when reverse development processes are applied, thin lines and independent dots can be difficult to reproduce.

With the exception of expensive and highly precise laser optical systems, variation and imprecision in the laser optical system will increase spot diameter of laser light for irradiating the photosensitive body to much greater than the theoretical value. Therefore, the power of the laser light will be dispersed over a larger area. As a result, the laser light will be incapable of sufficiently reducing the electric potential of the photosensitive drum to produce an appropriate electrostatic latent image.

Thin lines and independent dots are especially difficult to reproduce when using impression development with non-magnetic single component toner, which normally is uninfluenced by the edge effect.

SUMMARY OF THE INVENTION

It is an object of the present invention to overcome the above-described problems and to provide an image forming device capable of properly reproducing thin lines and independent dots even when a positively charging photosensitive drum and toner are used.

To achieve the above and other object, the present invention provides an image forming device that includes a photosensitive member, an electrostatic latent image forming unit, and a developing agent bearing member. The electrostatic latent image forming unit forms an electrostatic latent image on the photosensitive body while the photosensitive body is moving. The developing agent bearing member bears and transports a developing agent onto the photosensitive member. The developing agent bearing member contacts the photosensitive body at a nip portion between the developing agent bearing member and the photosensitive body. The developing agent bearing member performs image development to develop at the nip portion the electrostatic latent image on the photosensitive body into a visible image using the developing agent. The developing agent is formed from a material that, when image development is performed by the developing agent bearing member, is charged by friction at the nip portion to a greater charge amount after image development than before image development.

According to the present invention, the electrostatic latent image forming unit forms an electrostatic latent image on the moving photosensitive body. Next, the developing agent bearing member performs image development to develop the electrostatic latent image on the photosensitive body with developing agent into a visible image on the photosensitive body.

During this development process, the surface of the photosensitive body, the surface of the developing agent bearing member, and the developing agent are rubbed against each other at the nip portion between the photosensitive body and the developing agent bearing member. As a result, developing agent on the developing agent bearing member is charged to a predetermined charge in a- predetermined polarity.

However, since the developing agent on the developing agent bearing member has a greater charge after image development than before image development, when the developing agent contacts the photosensitive layer of the photosensitive body, the charge of the photosensitive layer migrates to the developing agent so that electric potential between the photosensitive body and the developing agent bearing member increases. As a result, fine lines and independent dots can be properly developed and properly reproduced.

It is preferable that the surface of the photosensitive body be formed from a positively charging organic photosensitive body and the toner is a positively charging toner. To develop the electrostatic latent image on the positively charging organic photosensitive body using positively charging toner, the organic photosensitive body is charged to a positive polarity to form images using reverse development processes. Accordingly, less ozone is generated than if the organic photosensitive body were charged to a negative polarity to form images. This is advantageous from an environmental view point.

Furthermore, the positively charging toner contacts with the photosensitive layer of the photosensitive body and charge of the photosensitive layer is transferred to the toner so that electric potential of the photosensitive body is reduced. As a result, image development of thin lines and independent dots can be properly performed and thin lines and independent dots are properly reproduced.

It is preferable to use toner and at least one of nigrosine and triphenyl-methane as the charge controlling agent As a result, charge characteristic of the toner Is such that the developing agent on the developing agent bearing body has a greater charge amount after image development than before image development. Accordingly, when the toner contacts the photosensitive surface of the photosensitive body, the charge of the photosensitive layer migrates to the toner so that the electric potential of the photosensitive body is reduced. Fine lines and independent dots can be properly developed and properly reproduced.

At the nip portion between the developing agent bearing member and the photosensitive body, the developing agent bearing member transports the developing agent in a direction opposite to the direction of movement of the photosensitive body. With this configuration, in an image forming device wherein the position where the visible image is transferred onto a recording medium and the transport pathway of the recording medium are disposed above the image forming device, then the developing agent bearing member will transport the developing agent upward, that is, from within a container below the image forming device to the transfer position and the transport pathway above the image forming device. As a result, developing agent with poor charge characteristic and the like will be prevented from collecting below the developing agent bearing member and proper image development can be performed over a long periods of time.

BRIEF DESCRIPTION OF THE DRAWINGS

The above and other objects, features and advantages of the invention will become more apparent from reading the following description of the preferred embodiment taken in connection with the accompanying drawings in which:

FIGS. 4(A) through 4(F) are schematic views showing examples of electric potential at single and plural dot of an electrostatic latent image on the photosensitive drum wherein:

FIG. 4(A) is an explanatory diagram showing an example electric potential at an electrostatic latent image before a development process according to a conventional laser beam printer;

FIG. 4(B) is an explanatory diagram showing electric potential at an electrostatic image after development processes performed according to the present invention;

FIG. 4(C) is an explanatory diagram showing an example at electric potential of an electrostatic latent image after an image developing process according to the conventional laser beam printer wherein charge amount of toner is the same both before and after the toner passes by the nip portion;

FIG. 4(D) is an explanatory diagram showing electric potential at an electrostatic image after an image developing process according to the conventional laser beam printer wherein charge amount of toner drops after the toner passes the nip portion:

FIG. 4(E) is an explanatory diagram showing a potential difference between the surface potential at a photosensitive drum and the development bias voltage wherein the surface potential of the photosensitive drum is properly maintained;

FIG. 4(F) is an explanatory diagram showing a potential difference between the surface potential at a photosensitive drum and the development bias voltage wherein the surface potential of the photosensitive drum becomes too low;

DETAILED DESCRIPTION OF THE PREFERRED EMBODIMENT

Figure 1A:
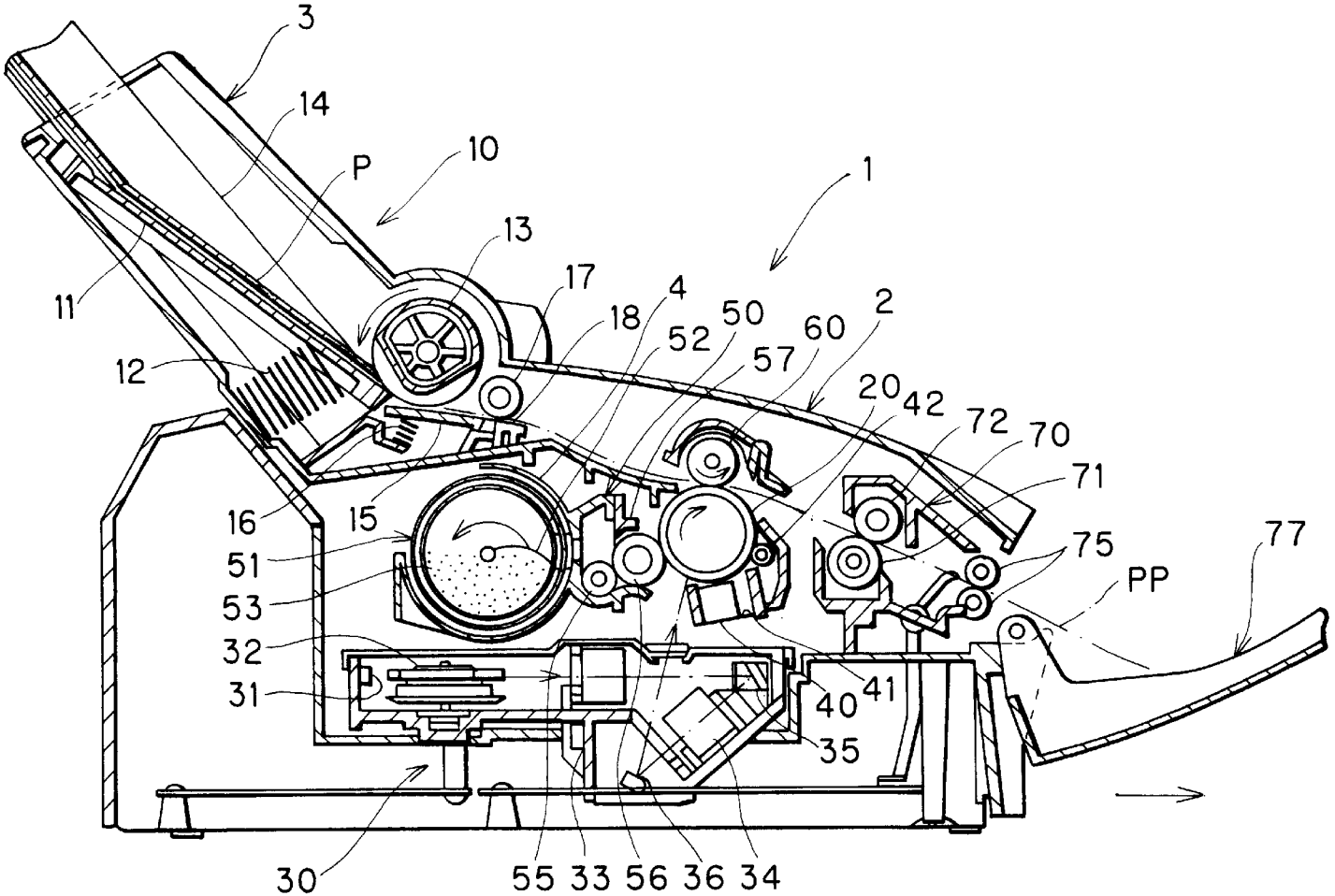
FIG. 1(A) is a cross-sectional view showing a laser beam printer according to an embodiment of the present invention.

An image forming device according to a preferred embodiment of the present invention will be described while referring to the accompanying drawings wherein like parts and components are designated by the same reference numerals to avoid duplicating description.

FIG. 1 shows a laser beam printer 1 according to an embodiment of the present invention. The laser beam printer 1 includes: a case 2; a feeder unit 10 for supplying sheets P which serve as an example of a recording medium on which images are formed; a photosensitive drum 20 [, which serves as an example of a photosensitive body,] on which a series of image forming processes, such as exposure, development, transfer and, toner recovery, are performed: a fixing unit 70 for fixing an image transferred from the photosensitive drum 20 onto the sheet P; and a discharge tray 77 on which the sheet P with image fixed thereon is discharged after following a transport pathway PP.

Although not shown in the drawings, the laser beam printer 1 is also provided with a drive means including a motor, gear trains, and the like for rotating the photosensitive drum 20. Further, a variety of components are disposed around the photosensitive drum 20. For example, a laser scanner unit 30, a developing unit 50, a transfer roller 60, a cleaning roller 42, an a charge unit 40 are disposed around the photosensitive drum 20 in the order listed.

The laser scanner unit 30 [serves as an example of an electrostatic latent image forming means] is for forming an electrostatic latent image on the surface of the photosensitive drum while the photosensitive drum 20 is rotated by the drive means. The developing unit 50 includes a developing roller 56 for using toner to develop the electrostatic latent image formed on the photosensitive drum 20 into a toner image. The transfer roller 60 is for transferring the toner image developed on the photosensitive drum 20 onto a sheet P.

The cleaning roller 42 uses a to return residual toner from the surface of the photosensitive drum 20 back to the toner box 51. The cleaning roller 42 temporarily absorbs residual toner remaining on the surface of the photosensitive drum 20 after the toner image has been transferred by the transfer roller 60. The cleaning roller 42 then operates at a predetermined timing in order to return the residual toner to the photosensitive drum 20 and then the toner box 51 of the developing unit 50. The charge unit 40 is for, after the charge of the photosensitive drum 20 has been removed, charging the photosensitive drum 20 so that an electrostatic latent image can be formed on the surface of the photosensitive drum 20.

Next, a detailed explanation of various components of the laser beam printer 1 will be described while referring FIGS. 1(A), 2, and 3.

As shown in FIG. 1(A), the feeder unit 10 includes a feeder case 3 and a sheet pressing plate 11. The feeder case 3 is positioned at the rear edge of the case 2. The sheet pressing plate 11 has substantially the same width as the sheet P. The sheet pressing plate 11 is swingably supported at its rear edge in the feeder case 3. A compression spring 12 resiliently urging the front edge of the sheet pressing plate 11 upward is provided at the front edge of the sheet pressing plate 11. A laterally-extending sheet feed roller 13 is freely, rotatably disposed at the front edge of the sheet pressing plate 11. Although not shown in the drawings, a drive system is provided for rotatably driving the sheet feed roller 13 at a sheet feed timing. A sheet feed cassette 14 capable of housing a plurality of sheets P formed from sheets cut in a predetermined shape is freely, detachably mounted at an oblique angle to the feeder case 3. With this configuration, rotation of the sheet feed roller 13 feeds one sheet P at a time from sheets P contained in the sheet feed cassette 14.

Further, the feeder unit 10 includes a separation member 15 at a lower edge of the sheet feed roller 13. The separation member 15 is for preventing redundant feed of sheets P. A compression spring 16 is provided for resiliently urging the separation member 15 toward the sheet feed roller 13. A pair of resist rollers 17, 18 are rotatably disposed at a downstream side of a transport direction, that is, left to right in FIG. 1, from the sheet feed roller 13. The pair of resist rollers 17, 18 are for aligning the front edge of the sheets fed from the sheet feed roller 13 in what will be referred to hereinafter as resist operation.

Figure 2:
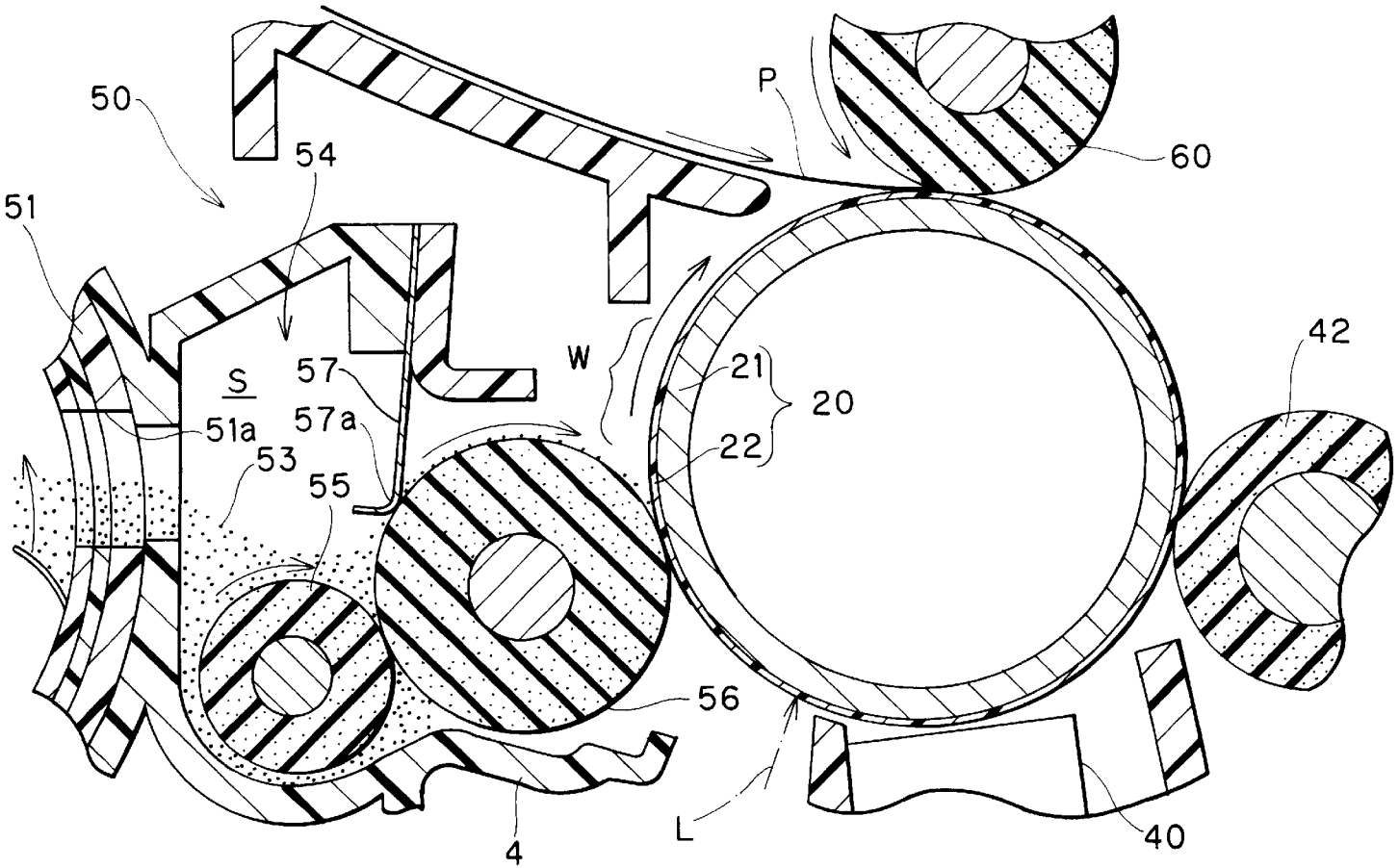
FIG. 2 is an enlarged cross-sectional view of a developing unit and a photosensitive drum of the laser beam printer of FIGS. 1(A) and 1(B)

The photosensitive drum 20 shown in FIGS. 1(A) and 2 is formed from a positively charging material, for example, an organic photosensitive body having a main component of positively charging polycarbonate. As shown more detail in FIG. 2, the photosensitive drum 20 is a hollow-shaped drum including an aluminum cylindrical sleeve 21 and a photoconductlve layer 22 formed around the cylindrical sleeve 21. The cylindrical sleeve 21 is freely, rotatably disposed with respect to the case 2 and is maintained in connection with ground as it rotates. The photoconductive layer 22 has a predetermined thickness of, for example, 20 $\mu$m and is formed from polycarbonate dispersed with a photoconductive resin The laser beam printer 1 uses reverse development to develop the positive polarity electrostatic latent image formed on the photosensitive drum 20 using toner 53 charged to a positive polarity. Although not shown in the drawing, a drive means is provided for driving rotation of the photosensitive drum 20 in the clockwise direction as viewed in FIGS. 1(A) and 2.

As shown in FIG. 1(A), the laser scanner unit 30 is disposed below the photosensitive drum 20. The laser scanner unit 30 includes a laser generating unit 31 for generating laser light L for forming an electrostatic latent image on the surface of the photosensitive drum 20; a polygon mirror 32 which is driven to rotate; a pair of lenses 33, 34; and a pair of reflection mirrors 35, 36. By disposing the laser scanner unit 30 below the photosensitive drum 20, the overall length of the laser beam printer 1 in the sheet transport direction can be shorter so that the laser beam printer 1 can be made in a more compact shape. Further, electrostatic latent images can be formed on the photosensitive drum 20 using laser light L emitted from the laser scanner unit 30, without the need to take sheet transport into consideration.

The charge unit 40 is a scorotoron type charge unit for generating corona discharge from a charge wire made of tungsten, for example, to positively charge the surface of the photosensitive drum 20. Although the present embodiment uses a cleanerless method, the charge unit 40 is disposed in opposition with, but not touching, the photosensitive drum 20. As a result, residual toner on the surface of the photosensitive drum 20 does not cling to the charge unit 40.

A charge removing lamp 41 includes a light source, such as a laser emitting diode (LED), an electroluminescence (EL), or a fluorescent lamp. The charge removing lamp 41 removes residual charges from the surface of the photosensitive drum 20 after transfer operation. Because no residual charge will remain on the photosensitive drum 20, the next electrostatic latent image will not be affected by residual charge so that residual charge will not appear as an image finally formed on the sheet P.

The cleaning roller 42 is capable of developing different bias voltages. First, one bias voltage is developed so that toner 53 remaining on the surface of the photosensitive drum 20 after the transfer roller 60 performs transfer processes is temporarily absorbed on the surface of the cleaning roller 42. Then, at a timing which does not interfere with a subsequent exposure, development, and transfer operations on the surface of the photosensitive drum 20, a bias voltage is developed in the cleaning roller 42 that releases the absorbed residual toner 53 back onto the surface of the photosensitive drum 20. Rotation of the photosensitive drum 20 returns the toner 53 back to the developing unit 50. The cleaning roller 42 is formed from a conductive resilient form material, such as silicone rubber or urethane rubber, capable of being energized with a bias voltage. It should be noted that the cleaning roller 42 is provided to efficiently collect toner using the cleanerless method. However, in addition to the cleaning roller 42, a cleaning brush can be provided for removing residual toner from the surface of the photosensitive drum 20.

As shown in FIGS. 1(A) and 2, the developing unit 50 includes a double cylindrical toner box 51 which is detachably mounted in a developing case 4. A rotatably driven agitator 52 is provided in the toner box 51. The toner box 51 stores positively chargeable toner 53 having electrically insulating properties. A toner chamber 54 is formed at the front side of the toner box 51. A toner supply port 51*a* is formed in the toner box 51. The toner chamber 54 stores toner 53 supplied by rotation of the agitator 52 through the toner box 51. A supply roller 55 extending horizontally in its lengthwise direction is disposed in the toner chamber 54. The supply roller 55 is rotatably disposed in the toner chamber 54. The developing roller 56 is disposed in front of the toner chamber 54 so as to partition the toner chamber 54 from the rest of the laser beam printer 1. The developing roller 56 is disposed so as to extend horizontally in its lengthwise direction and is rotatably supported in contact with both the supply roller 55 and the photosensitive drum 20.

The supply roller 55 Is formed from resilient foam material having conductive properties such as silicone rubber and urethane rubber. The supply roller 55 has a resistance value where it contacts the developing roller 56 of about $5\times10^4$ to $1\times10^8$ Ω.

The developing roller 56 is a rigid roller formed from a conductive material such as silicone rubber or urethane rubber. In the present embodiment, toner and main components of the photosensitive drum 20, that is, organic photosensitive material such as polycarbonate, are both positively charging materials. For this reason, the developing roller 56 is formed from urethane rubber.

The developing roller 56 has an electrode in its center portion for applying developing bias voltage to the developing roller 56. The resistance value between the electrode and the outer periphery contact portion of the developing roller 56 is set to about $5\times10^4$ to $1\times10^7$ Ω. The supply roller 55 and the developing roller 56 are driven to rotate in the clockwise direction by a drive mechanism.

The developing roller 56 performs image developing processes on the photosensitive drum 20 using positively charging toner 53 and also collects residual toner 53 returned to the photosensitive drum 20 from the cleaning roller 42.

In more concrete terms, residual toner 53 remaining on the surface of the photosensitive drum 20 after transfer operation equals about ten percent of the toner amount on the surface of the photosensitive drum 20 before transfer operation. First, exposure is performed so that the laser can sufficiently reach the residual toner 53 from the laser scanner unit 30 when the photosensitive drum 20 has about ten percent residual toner thereon. Then, regardless of whether or not residual toner 53 exist on the photosensitive drum 20, the developing unit 50 utilizes the difference between exposed and non-exposed portions on the photosensitive drum 20 to move, that is, collect, residual toner 53 if residual toner 53 clings to unexposed portions of the photosensitive drum 20. At the same time, if residual toner 53 already is clinging to exposed portions of the photosensitive drum 20, then the exposed portions are developed using the previously clinging residual toner 53, If residual toner 53 is not clinging to the exposed portions of the photosensitive drum 20, then positively charged toner 53 from the developing roller 56 is used to develop the exposed portions of the photosensitive drum 20. With this configuration, the developing roller 56 can perform its developing cycle almost simultaneously with its residual toner collection cycle.

As shown in FIG. 2, the toner chamber 54 is provided to the developing case 4 in the developing unit 50. The toner chamber 54 has provided thereto a large space S above the supply roller 55. Because of this large space S, toner 53 will not become packed or hardened even when supplied in great quantities through the toner supply port 51*a* to the toner chamber 54. Therefore, the toner 53 will always be in a power condition with good fluidity characteristics so that toner can be stably supplied by the supply roller 55.

As shown in FIGS. 1(A) and 2, a layer regulating blade 57 is attached to the developing case 4. The layer regulating blade 57 is formed into a resilient thin plate shape from stainless steel or phosphor bronze.

An angled portion 57*a* is formed at the lower tip of the layer regulating blade 57. The angled portion 57*a* contacts and presses against the developing roller 56. As a result, the angled portion 57*a* regulates toner 53 supplied from the supply roller 55 and clinging in a layer to the surface of the developing roller 56 into a layer equal to about a thickness of single toner particle, that is, about 7 to 12 μm. That is, the angled portion 57*a* regulates the amount of toner on the developing roller 56 to equal to or less than 0.5 mg/cm$^2$. The layer regulating blade 57 is desirably set to have a radius of curvature of about 0.3 mm in order to regulate toner amount on the developing roller 56 to about 0.4 mg/m$^2$. It should be noted that the toner amount on the developing roller 56 is regulated to its minimum limit by a developing bias, a number of rotations of the developing roller 56, and the like. However, if the toner amount on the developing roller 56 is, for example, about 0.3 mg/cm$^2$, image development can be performed at sufficient toner density using a developing bias and a number of rotations of the developing roller 56 within a practical range. The thickness of the toner layer is regulated by the layer regulating blade 57 to produce a layer having a toner amount of 0.5 mg/cm$^2$ or less. Therefore, the thickness of the layer of toner 53 on the developing roller 56 is less than two layers when one layer is based on the thickness of a toner particle. That is, the thickness of the layer of toner 53 on the developing roller 56 is one layer thick or little more than one layer thick. As a result, most of toner 53 on the developing roller 56 is properly rubbed against by the developing roller 56 and the layer regulating blade 57 and charged to a positive polarity. The toner 53 after it has been regulated to a predetermined thickness on the surface of the developing roller 56 is one or little more than one layer thick. Therefore, the toner 53 not used during image development clings to the developing roller 56 and is returned to the toner chamber 54 without accumulating at the contact position between the photosensitive drum 20 and the developing roller 56.

Figure 3:
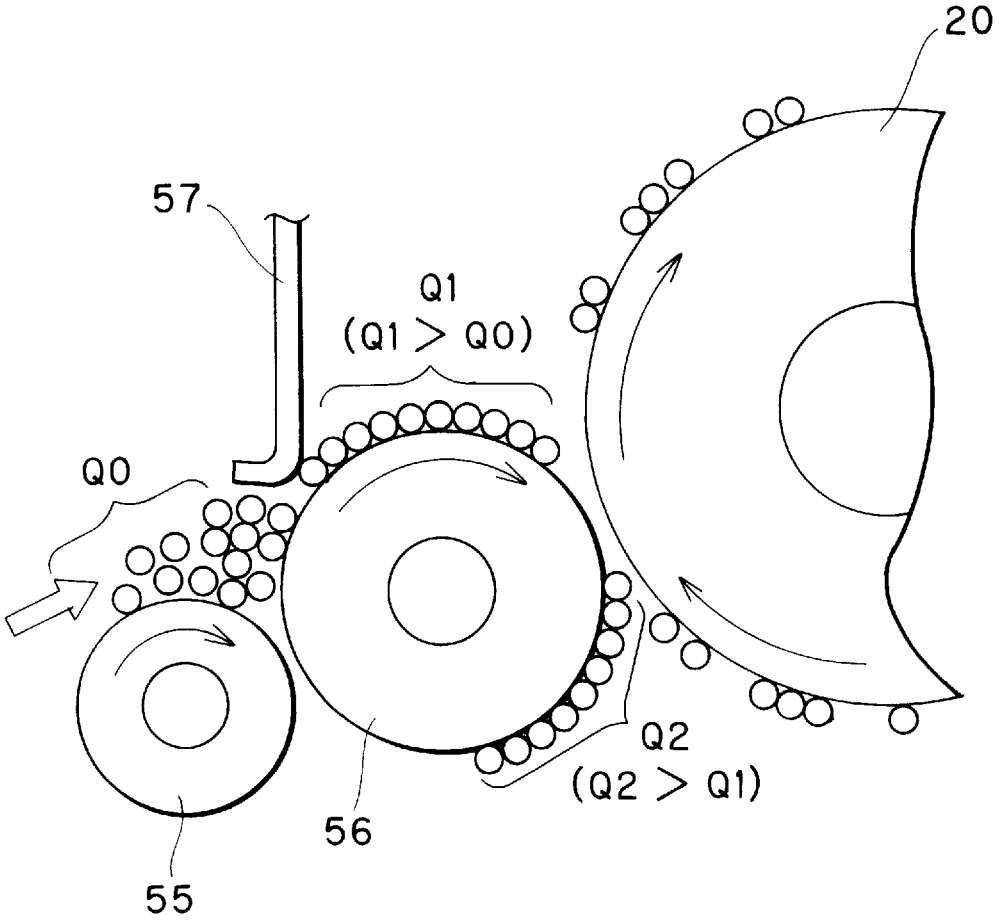
FIG. 3 is an enlarged plan view schematically showing charge amounts of toner at various positions in the laser beam printers of FIGS. 1(A) and 1(B)

As shown in FIG. 3, the toner 53 on the developing roller 56 is rubbed by the layer regulating blade 57. The layer regulating blade 57 and the developing roller 56 are disposed to charge the toner 53 when rubbed by the layer regulating blade 57 to a low first charge amount Q1, which is greater than zero charge and less than saturated charge amount of the toner 53. It is assumed that toner 53 has charge amount Q0, which is near zero, before being rubbed by the layer regulating blade 57. In other words, the low first charge amount Q1 is greater than Q0.

Further, toner 53 on the developing roller 56 is again rubbed at a nip portion between the developing roller 56 and the photosensitive drum 20. Charge series is selected to charge the toner 53 at the nip portion to a large second charge amount Q2, which is greater than the first charge amount Q1 of the toner 53 before rubbed again at the nip portion.

The transfer roller 60 is freely, rotatably disposed above the photosensitive drum 20 so as to contact the photosensitive drum 20 from above. The transfer roller 60 is formed from resilient and conductive foam such as silicone rubber or urethane rubber. The resistance value at a location where the transfer roller 60 and the photosensitive drum 20 contact each other is set to about $1\times10^{6}$ to $1\times10^{10}$ Ω. That is, because the transfer roller 60 contacts the surface of the photosensitive drum 20, by setting a resistance value to a large value, the photoconductive layer 22 formed on the photosensitive drum 20 is unlikely to be damaged by voltage applied to the transfer roller 60. Further, toner image on the photosensitive drum 20 can be reliably transferred to the sheet P.

The fixing unit 70 is provided downstream in a transport direction from the photosensitive drum 20. The fixing unit 70 includes a pressing roller 72 and a heating roller 71. The heating roller 71 is provided with internal halogen lamp. With this configuration, the fixing unit 70 heats while pressing the toner image transferred to the lower surface of the sheet P, thereby fixing the toner image onto the sheet P.

A pair of transport rollers 75 and a discharge tray 77 are provided downstream in the transport direction from the fixing unit 70.

Figure 7:
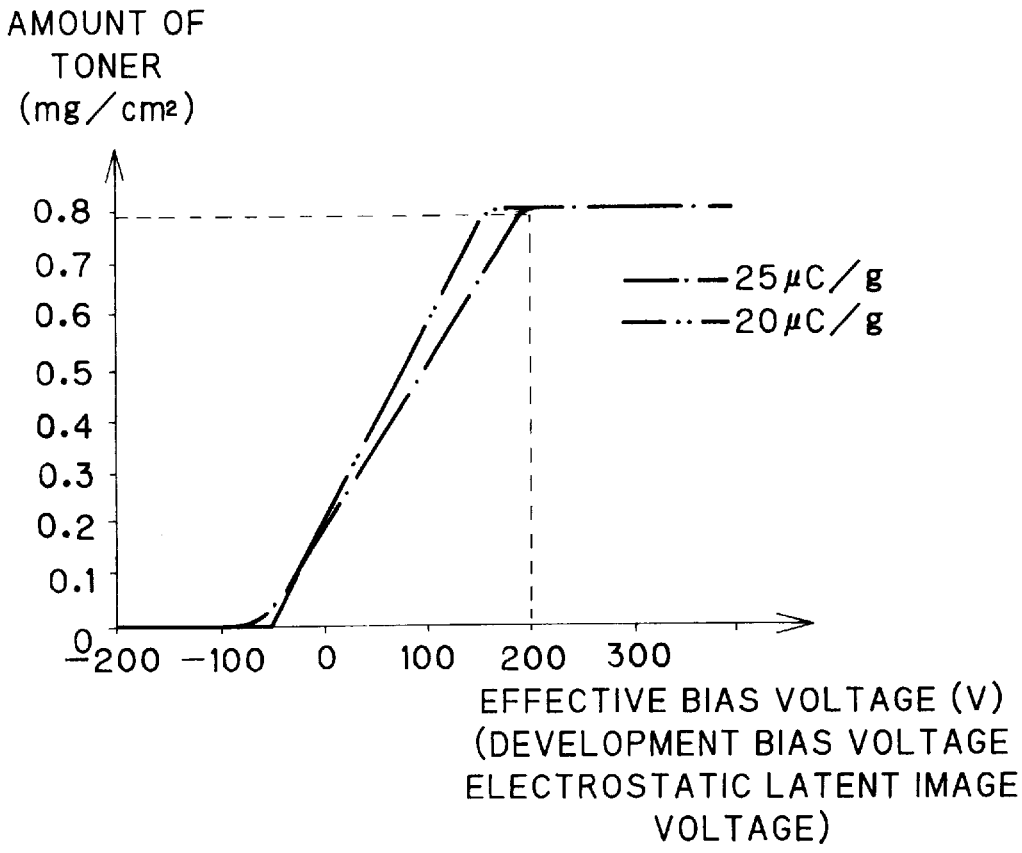
FIG. 7 is a graphical representation of the relationship between effective bias voltage and amount of development toner in the laser beam printer of FIG. 1(A)

As shown in FIG. 7, the compression spring 12, the photosensitive drum 20, the fixing unit 70, and the discharge tray 77 are disposed substantially in a straight line to form the transport pathway PP indicated by a single dot chain line in FIG. 1(A). Sheets P supplied from the sheet feed cassette 14 are transported along the transport pathway PP. The toner 53 according to the first embodiment shown in FIG. 1(A) is, for example, non-magnetic single component toner, such as pulverized toner or compound toner. The compound toner can be formed from substantially spherical styrene acrylic. Each particle of the toner 53 has a diameter of about 6 to 12 μm.

The toner 53 includes toner base and silica. The silica is an example of an additive added to the toner base in order to provide the toner base with better fluidity characteristic, for example. The toner base includes, for example, resin, wax, carbon black, and charge controlling agent (CCA). An example of CCA is nigrosine and triphenyl-methane. The toner base has a positive polarity charge characteristic because of operation of charge controlling agent. The silica is modifier on the surface of the toner for increasing fluidity of the toner 53. Generally, the silica has a negative polarity charge characteristic. However, examples of silica with a positive charge characteristic having charge polarity charged to positive polarity are silica processed using. However, positive charge characteristic silica does not sufficiently improve fluidity of the toner. Therefore, silica having a slightly negative charge characteristic is often used an additive to the toner base. The difference between positively charging silica and negatively charging silica is that when added to the outside of the toner base, the positively charging toner increases the toner charge amount in a positive direction and the negatively charging silica increases the charging amount of the toner in a negative direction.

The toner 53 configured in this manner is charged to a positive polarity, which is the charge characteristic of the toner base, when sufficiently rubbed against at the nip portion between the developing roller 56 and the photosensitive drum 20 as controlled by the charge characteristic of the charge control agent included in the toner base.

The additive in addition to increasing fluidity of the toner can also prevent toner blocking, can improve cleanability, can prevent damage to such scratches to the photosensitive drum 20, can improve the density of image, and can improve image quality. Examples of additive other than silica are colloidal silica, titanium oxide, aluminum oxide, (alumina), and other powered materials.

Because toner 53 having the above-described configuration is used in the first embodiment, the charge amount to the toner 53 on the developing roller 56 is can be larger after passing through the nip portion than before passing through the nip portion. When the toner 53 contacts the surface of the photosensitive drum 20 at the nip portion, the charge of the photosensitive layer of the photosensitive drum 20 Is transferred to the toner 53 so that electric potential at the surface of the photosensitive drum 20 is reduced.

As a result, potential difference increases between the developing roller 56 and the electrostatic latent image on the photosensitive drum 20. Therefore, thin lines and independent dots can be more reliably and accurately reproduced.

Figure 4A:
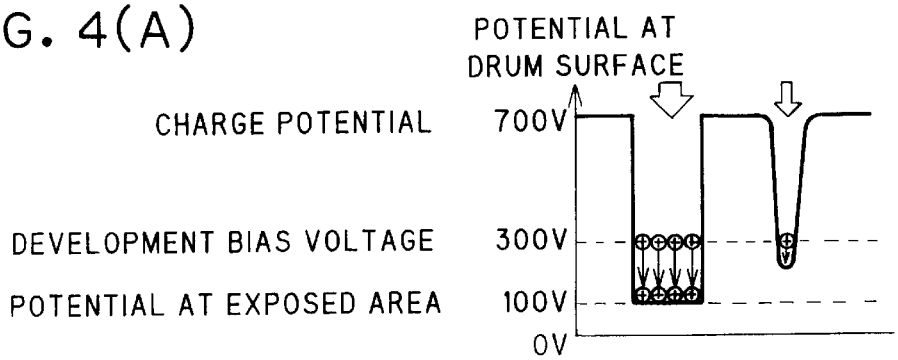

For example, when the surface of the photosensitive drum 20 is charged to an electric potential of 700 V, a developing bias is 300 V, and the electric potential at exposed portions on the photosensitive drum 20 is 100 V, then as shown in FIG. 4(A). the electric potential at single dot with resolution of 600 dpi. The electric potential is about the same as the developing bias.

Figure 4B:
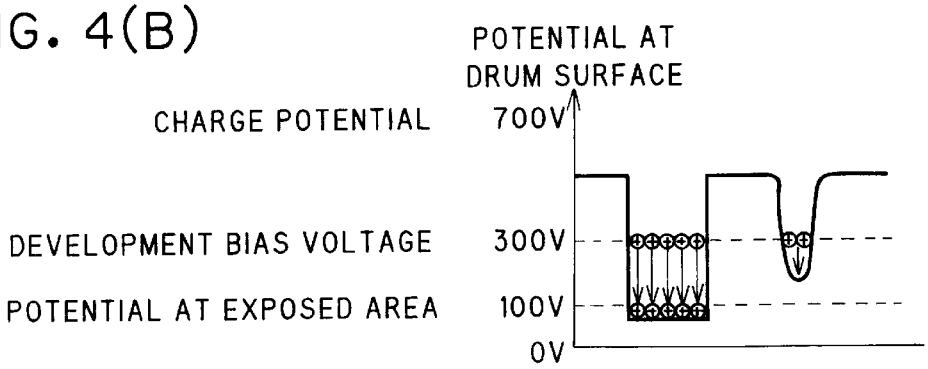
Figure 4C:
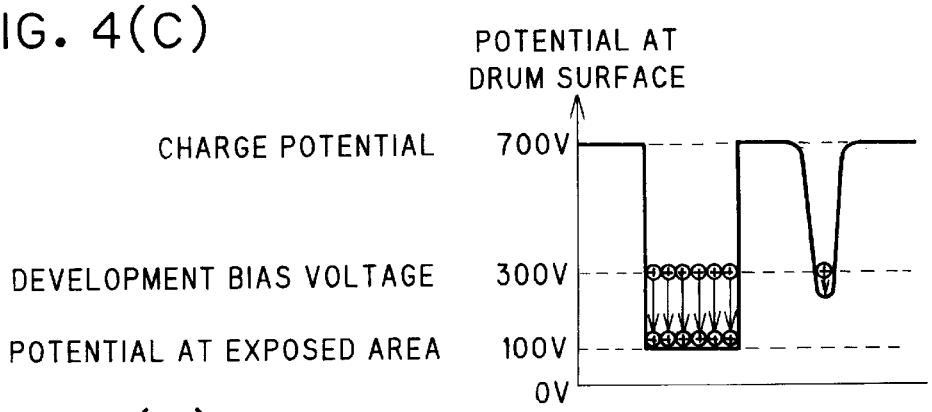

Accordingly, as shown in FIG. 4(C), when the charge amount of the toner 53 after passing through the nip portion is equivalent to the charge amount of the toner 53 before the toner 53 passed through the nip portion, the electric potential of the electrostatic latent image will not change and charge will not transferred to the toner 53. Therefore, the single dot having an electric potential about the same as the developing bias will not be properly reproduced.

Figure 4D:
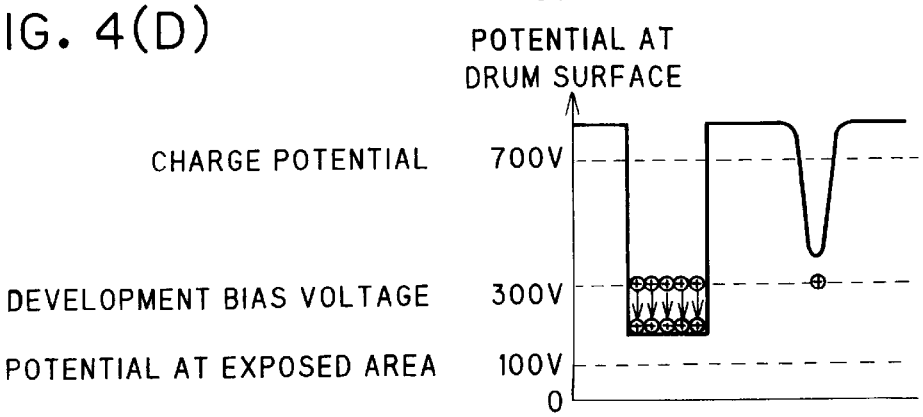

Further, as shown in FIG. 4(D), when the toner 53 has a smaller charge amount after it passes through the nip portion before it passes through the nip portion, charge of the toner 53 will be transferred to the electrostatic latent image on the photosensitive drum 20 and the electrostatic latent image on the photosensitive drum 20 will increase. As a result, electric potential of a single dot become greater than the developing bias so that the single dot will not be reproduced at all. However, as shown in FIG. 4(D), when the toner 53 has a greater charge amount after it passes through the nip portion than before it passes through the nip portion, then the charge of the photosensitive layer of the photosensitive drum 20 is transferred to the toner 53 so that electric potential of the electrostatic latent image on the photosensitive drum 20 is reduced The electric potential of the single dot is sufficiently lower than the developing bias so that the single dot is properly reproduced.

A device was made according to the first embodiment The through rate of the device was set at 3 ppm. The process speed, that is, the peripheral speed of the photosensitive drum 20 was set at 65 mm/sec. The peripheral speed of the photosensitive drum 20 was set at 70 mm/sec. The peripheral speed of the supply roller 55 was set at 17 to 30 mm/sec. The developing bias was set at 300V and the surface of the photosensitive drum 20 was charged to an electric potential of 700 V. Further, styrene acrylic was used as toner. The toner included 0.2% by weight of nigrosine or 2% by weight of triphenyl-methane. Three aspects of the toner layer on the developing roller 56 were measured The charge amount per unit of toner by mass Q/M, that is, $\mu$C/g, the mass of toner per unit of surface area M/A (mg/cm$^2$), and the surface electric potential $V_0$ (V) of the photosensitive drum 20 were measured.

| | Before passing through the nip portion | After passing through the nip portion |
|---|---|---|
| Q/M: | 20($\mu$C/g) | 27($\mu$C/g) |
| M/A: | 0.5(mg/cm$^2$) | 0.5(mg/cm$^2$) |
| $V_0$ | 700(V) | 550(V) |

As indicated above, it could be confirmed that an electric potential on the surface of the photosensitive drum 20 decreases when the charge amount of the toner 53 after toner 53 passes through the nip portion increases.

A second embodiment of the present invention will next be described.

Figure 1B:
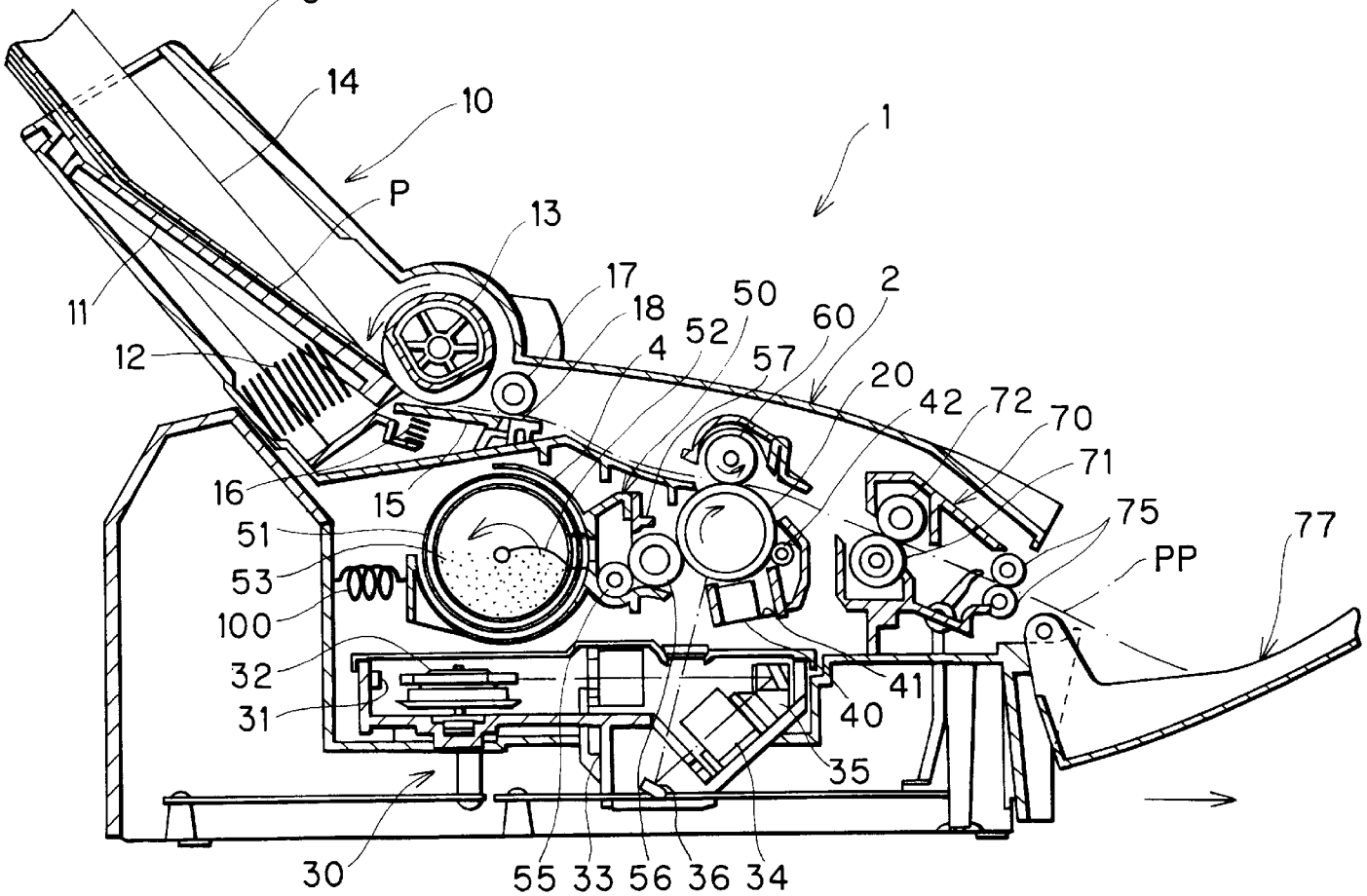
FIG. 1(B) is a cross-sectional view showing a laser beam printer according to another embodiment of the present invention.

The laser beam printer used in the second embodiment is shown in FIG. 1(B), which is similar to that of FIG. 1(A) but different therefrom in that the developing unit 50 is biased toward the photosensitive drum 20 by virtue of a coil spring 100. The pressing force of the developing roller 56 against the photosensitive drum 20 is determined dependent on the coil spring 100 and the resiliency of the developing roller itself.

In the second embodiment, not only the additive of the toner that can be used in the first embodiment but also additive of negative polarity charge characteristic can be used.

The second embodiment was made in view of the recognition that when the charge level of the toner 53 becomes too high after it has passed through the nip, charge transfer from the photosensitive drum 20 to the toner 53 will be too great, resulting in the electrostatic latent image on the photosensitive drum 20 having an Insufficiently low electric potential.

Figure 4E:
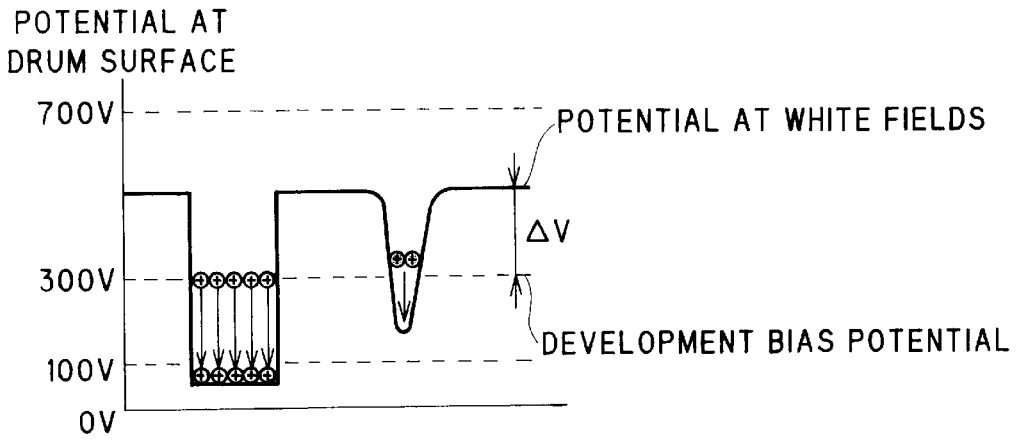

For example, when the electric potential of the latent electrostatic image on the photosensitive drum 20 decreases properly as shown in FIG. 4(E), then a potential difference ÅV between electric potential at white fields (unexposed portions) and the development bias will be sufficient to prevent toner blotches from undesirably appearing to white fields.

Figure 4F:
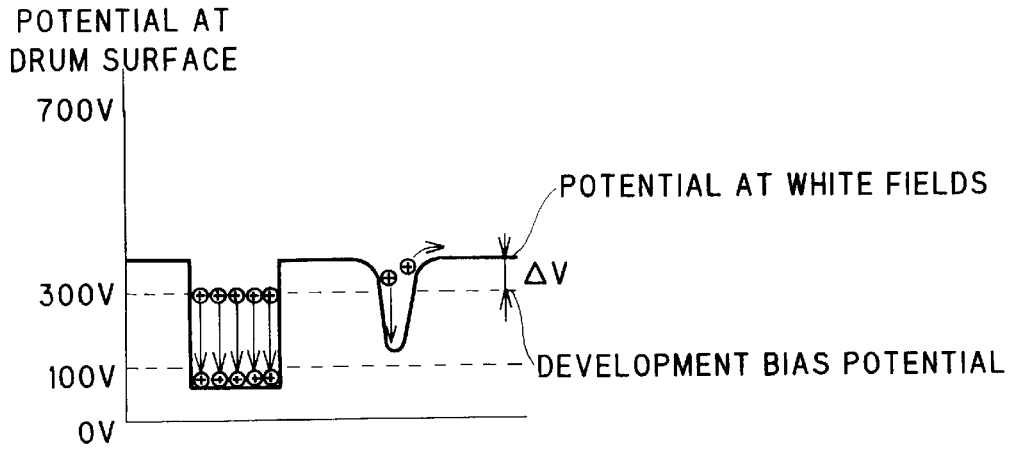

However, when the electric potential of the electrostatic latent image on the photosensitive drum 20 decreases causing the potential difference ÅV to be a small value as shown in FIG. 4(F), then some positively charged toner will drift to the white fields portions, resulting in undesirable toner blotches in the white fields.

In order to prevent drops in charge amount developed in the toner 53 by friction at the nip portion, the developing roller 56 according to the second embodiment is pressed against the photosensitive drum 20 with less force than in the conventional situation According to the second embodiment, as shown in FIG. 1(B), the pressing force of the developing roller 56 against the photosensitive drum 20 is dependent on the spring constant of the coil spring 100 that urges the developing unit 50, on the resiliency of the developing roller itself. Accordingly, the optimum pressing force can be determined by switching between a plurality of coil springs 100 having different spring constants and comparing the amount of toner blotching.

Experiments were actually performed using a plurality of different coil springs 100. When the pressing force at one side of the developing roller 56 was set to about 700 gf or less, pressing force against the photosensitive drum 20, that is, including the resiliency of the developing roller 56 itself, was found to be appropriate so that toner blotching could be prevented.

During these experiments, pressing force of the developing roller 56 against the photosensitive drum 20 were measured using the following method. A shaft for measuring pressing force was provided to both tips of the shaft of the developing roller 56 and the shaft was attached to a spring scale. Then, while the printer was not operating, the spring scale was pulled so as to pull the developing roller 56 away from the photosensitive drum 20. The value of the spring scale at the time when the developing roller 56 separated from the photosensitive drum 20 was read as the pressing force of the developing roller 56 against the photosensitive drum 20.

FIGS. 9(A), 9(B), 10(A) and 10(B) show comparisons of blotching generated when the pressing force was increased to greater than about 700 gf and when the pressing force was about 700 gf or less.

During these experiments, black fields were printed and their transmission density compared. Also, white fields were printed, that is, printing was performed based on print data with no black pixels. While printing white fields, toner 53 on the portion of the photosensitive drum 20 that was subjected to toner development, but not to toner transfer, that is, toner 53 indicated at portion W in FIG. 2, was transferred to mending tape and the mending tape was stuck onto a white paper sheet. At the same time, mending tape with not toner thereon was stuck onto the same white paper sheet. The reflection rate was measured for both tapes and the difference determined. The different in reflection rate was determined to be the amount of blotching on the photosensitive drum 20.

Figure 9A:
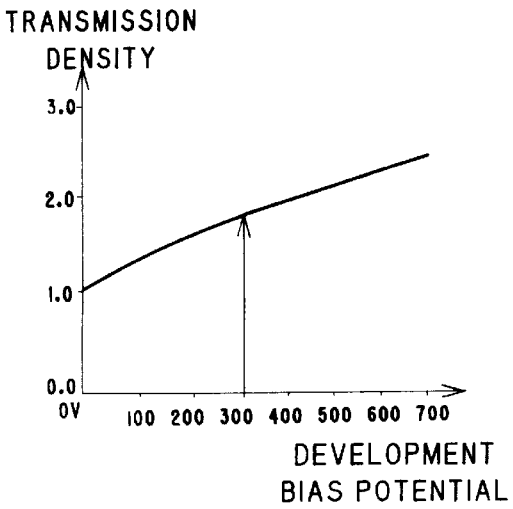
FIG. 9(A) is a graphical representation of the relationship between development bias voltage and transmission density in the laser beam printer of FIG. 1(A) or 1(B) measured after improvements according to various embodiments of the present invention.
Figure 9B:
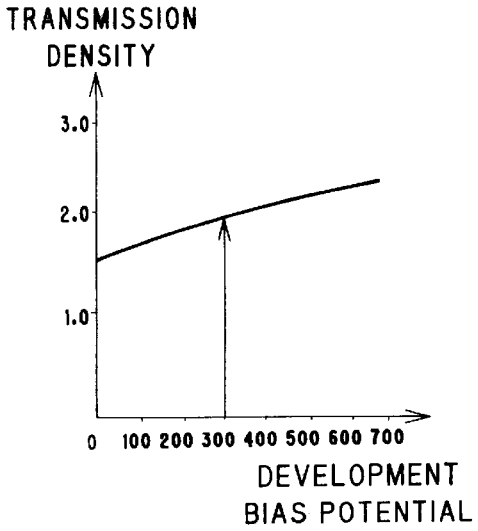
FIG. 9(B) is a graphical representation of the relationship between development bias voltage and transmission density in the laser beam printer of FIG. 1(A) or 1(B) measured before effecting improvements according to various embodiments of the present invention.

FIG. 9(A) is a graph showing measurements of transmission density when the pressing force was set at about 700 gf or less. FIG. 9(B) is a graph showing measurements of transmission density when the pressing force was set at larger than 700 gf. It can be seen in these graphs that the transmission density is lower when the pressing force is set to about 700 gf or lower.

Figure 10A:
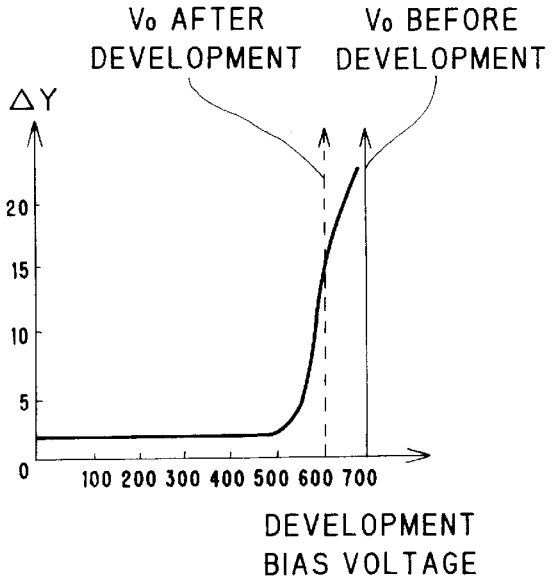
FIG. 10(A) is a graphical representation of the relationship between development bias voltage and blotching on the photosensitive drum after improvements according to various embodiments of the present invention.
Figure 10B:
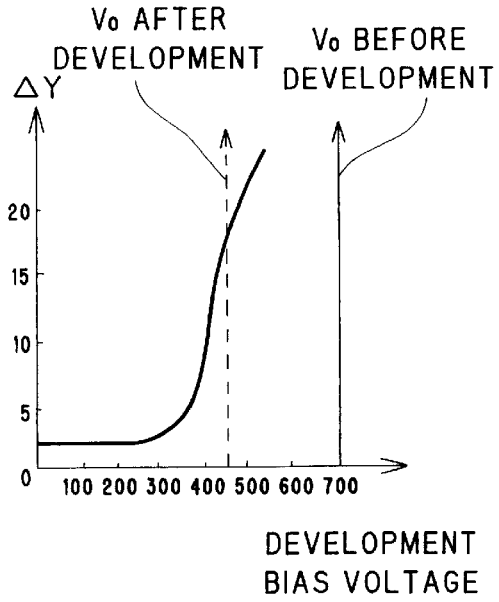
FIG. 10(B) is a graphical representation of the relationship between development bias voltage and blotching on the photosensitive drum before effecting improvements according to various embodiments of the present invention.

FIG. 10(A) is a graph showing measurements of blotching measured using the above-described method when the pressing force was set at about 700 gf or less. FIG. 10(B) is a graph showing measurements of blotching when the pressing force was set to greater than 700 gf. It can be seen in these graphs that electric potential $V_0$ at positions on the photosensitive drum corresponding to white fields decreased from 700V before development to 450 V after development when the pressing force was set to greater than 700 gf. but only from 700V to 600V when pressing force was set to about 700 gf or less. In this way; reduction in electric potential $V_0$ was relaxed by setting pressing force to about 700 gf or less so that blotching near the developing bias 300V remained at its lowest value.

The second embodiment was practiced under the following conditions described below. The pressing force of the developing roller 56 against the photosensitive drum 20 was set to 500 gf from one side. The through rate of the device was set at 6 ppm. The process speed, that is, the peripheral speed, of the photosensitive drum 20 was set at 35 mm/sec. The peripheral speed of the photosensitive drum 20 was set at 70 mm/sec. The peripheral speed of the supply roller 55 was set at 17 to 35 mm/sec. The developing bias was set at 300 V and the surface of the photosensitive drum 20 was charged to an electric potential of 700 V. Further, styrene acrylic was used as toner. The toner included 0.2% by weight of nigrosine or 2% by weight of triphenyl-methane. Three aspects of the toner layer on the developing roller 56 were measured. The charge amount per unit of toner by mass Q/M, that is, $\mu$C/g, the mass of toner per unit of surface area M/A (mg/cm$^2$), and the electric potential V (V) at the surface of the photosensitive drum 20 corresponding to white fields was measured.

When Pressing force is more than 700 gf:

| | Before passing through the nip portion | After passing through the nip portion |
|---|---|---|
| Q/M: | 20($\mu$C/g) | 35–40($\mu$C/g) |
| M/A: | 0.5(mg/cm$^2$) | 0.5(mg/cm$^2$) |
| V | 700(V) | 450(V) |

When pressing force is 700 gf or less:

| | Before passing through the nip portion | After passing through the nip portion |
|---|---|---|
| Q/M: | 20($\mu$C/g) | 25($\mu$C/g) |
| M/A: | 0.5(mg/cm$^2$) | 0.5(mg/cm$^2$) |
| V | 700(V) | 600(V) |

In this way, it can be confirmed that extreme decreases in the electric potential at the surface of the photosensitive drum 20 can be prevented while insuring that the toner 53 will be sufficiently charged by passing through the nip.

A third embodiment of the present invention will next be described.

Figure 11:
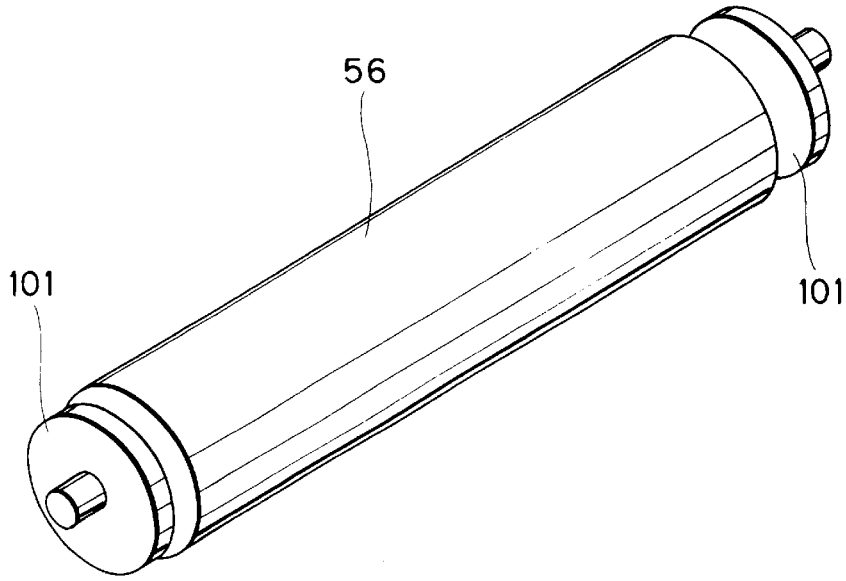
FIG. 11 is a perspective view showing a deformation amount regulating member used in the third embodiment of the present invention.

The laser beam printer used in the third embodiment is similar to that of FIG. 1(B). However, the laser beam printer of the third embodiment uses the developing roller 56 as shown in FIG. 11. As shown therein, regulating rollers 101 are disposed on the same rotational shaft as the developing roller 56, one at either end of the developing roller 56. The regulating rollers 101 are freely rotatable with respect to the developing roller 56. The regulating rollers 101 serve to regulate the amount at which the developing roller 56 is crushingly deformed when pressed against the photosensitive drum 20 by urging force of the coil spring 100.

The regulating rollers 101 are formed from polyoxymethylene (POM) and have a radius that is smaller than the radius of the developing roller 56. Therefore, when the developing roller 56 is pressed against the photosensitive drum 20 by urging force of the coil spring 100, the regulating rollers 101 will abut against the photosensitive drum 20 once the developing roller 56 has been crushingly deformed by a predetermined amount. In this ways the regulating rollers 101 regulate the amount that the developing roller 56 is crushingly deformed. By changing the diameter of the regulating rollers 101 the amount that the developing roller 56 deforms can be set to a desired amount. The deformation amount according to the present embodiment will be described in greater detail later.

The pressing force according to the third embodiment is defined not only by the spring constant of the coil spring 100, which as shown in FIG. 1(B) presses the developing unit 50 against the photosensitive drum 20. The pressing force also depends on the resiliency of the developing roller 56 itself. According to the third embodiment, even when the urging force of the coil spring 100 is a fixed value, the regulating rollers 101 adjust the deformation amount of the developing roller developing roller 56 so that the pressing force can be set to a desired value.

Actual experiments were performed using a plurality of regulating rollers 101 having different radii. The pressing force of the coil spring 100 against the developing roller 56 was set to about 1 to 2 kgf from one side. In this situation, when the radius of the regulating rollers 101 was the same or smaller than the radius of the developing roller 56 so that the difference between the two was about 100 $\mu$m or less, then the developing roller 56 was pressed against the photosensitive drum 20 by a pressing force suitable for preventing blotching.

It should be noted that during these experiments, pressing force applied on the developing roller 56 via the coil spring 100 was measured using the following method. Shafts for measuring pressing force were provided to both tips of the developing roller 56 and the shafts were attached to a spring scale. Then, while the printer was not operating, the spring scale was pulled so as to pull the developing roller 56 away from the photosensitive drum 20. The value of the spring scale at the time when the developing roller 56 separated from the photosensitive drum 20 was read as the pressing force of the developing roller 56 against the photosensitive drum 20.

FIGS. 9(A), 9(B), 10(A) and 10(B) are available to describe the experimental results of the third embodiment. These figures also show comparisons of blotching generated when the radius of the regulating rollers 101 was about 100 $\mu$m smaller than the radius of the developing roller 56, and when the radius of the regulating rollers 101 was less than 100 $\mu$m smaller than the radius of the developing roller 56.

During these experiments, black fields were printed and their transmission density compared. Also, white fields were printed, that is, printing was performed based on print data with no black pixels. While printing white fields, toner 53 on the portion of the photosensitive drum 20 that had been subjected to toner development, but had not yet been subjected to toner transfer, that is, toner 53 indicated at portion W in FIG. 2, was transferred to mending tape and the mending tape was stuck onto a white paper sheet. At the same time, mending tape with no toner thereon was stuck onto the same white paper sheet. The reflection rate was measured for both tapes and the difference determined. The difference in reflection rate was determined to be the amount of blotching on the photosensitive drum 20.

Here, FIG. 9(A) is a graph showing measurements of transmission density when the radius of the regulating rollers 101 was set to about 100 $\mu$m smaller than the radius of the developing roller 56. FIG. 9(B) is a graph showing measurements of transmission density when the radius of the regulating rollers 101 was set to less than 100 $\mu$m smaller than the radius of the developing roller 56. It can be seen in these graphs that the transmission density is lower when the radius of the regulating rollers 101 is set to about 100 $\mu$m smaller than the radius of the developing roller 56.

FIG. 10(A) is a graph showing measurements of blotching measured using the above-described method when the radius of the regulating rollers 101 was set to about 100 μm smaller than the radius of the developing roller 56. FIG. 10(B) is a graph showing measurements of blotching measured when the radius of the regulating rollers 101 was set to less than 100 μm smaller than the radius of the developing roller 56. It can be seen in these graphs that when the difference between radius of the regulating rollers 101 and the radius of the developing roller 56 exceeded 100 μm, electric potential $V_0$ at positions on the photosensitive drum corresponding to white fields decreased from 700V before development to 450 V after development. Blotching had already started increasing near the developing bias of 300 V.

In contrast to this, when the difference between radius of the regulating rollers 101 and the developing roller 56 is about 100 μm, electric potential $V_0$ at positions on the photosensitive drum corresponding to white fields decreased from 700V to only 600V. In this way, reduction in electric potential $V_0$ was eased by setting the difference between radius of the regulating rollers 101 and the developing roller 56 to about 100 μm, resulting in only the lowest amount of blotching near the developing bias of 300V.

Next, the third embodiment was practiced as described below The pressing force of the developing roller 56 against the photosensitive drum 20 was set to 1.2 kgf from one side. The radius of the regulating rollers 101 was set to about 100 μm less than the radius of the developing roller 56. The through rate of the device was set at 6 ppm. The process speed, that is, the peripheral speed of the photosensitive drum 20, was set at 35 mm/sec. The peripheral speed of the developing roller 56 was set to 70 mm/sec. The peripheral speed of the supply roller 55 was set at 17 to 35 mm/sec. The developing bias was set at 300V and the surface of the photosensitive drum 20 was charged to an electric potential of 700V. Further, styrene acrylic toner was used as the toner. The toner included 0.2% by weight of nigrosine, or 2% by weight of triphenyl-methane, as the charge controlling agent (CCA).

Three aspects of the toner layer on the developing roller 56 were measured: the charge amount per unit of toner by mass Q/M in terms of μC/g, the mass of toner per unit of surface area M/A (mg/cm$^2$), and the electric potential $V_0$ (V) at the surface of the photosensitive drum 20 corresponding to white fields.

When regulating roller radius was over 100 μm smaller than developing roller radius:

| | Before passing through the nip portion | After passing through the nip portion |
|---|---|---|
| Q/M: | 20(μC/g) | 35–40(μC/g) |
| M/A: | 0.5(mg/cm$^2$) | 0.5(mg/cm$^2$) |
| $V_0$ | 700(V) | 450(V) |

When regulating roller radius was about 100 μm smaller than developing roller radius:

| | Before passing through the nip portion | After passing through the nip portion |
|---|---|---|
| Q/M: | 20(μC/g) | 25(μC/g) |
| M/A: | 0.5(mg/cm$^2$) | 0.5(mg/cm$^2$) |
| $V_0$ | 700(V) | 600(V) |

In this way, it could be confirmed that extreme decreases in the electric potential at the surface of the photosensitive drum 20 can be prevented while Insuring that the toner 53 will be sufficiently charged by passing through the nip.

Next, a fourth embodiment of the present invention will be described. The fourth embodiment uses the laser beam printer shown in FIG. 1(A).

The fourth embodiment was also made in view of the recognition that when the charge amount of the toner 53 after having passed through the nip is too great, the amount of charge transferred from the photosensitive drum 20 to the toner 53 sometimes is too great so that the electric potential of the electrostatic latent image on the surface of the photosensitive drum 20 is too low.

According to the fourth embodiment, extreme increases in the charge amount that toner is charged to by passing through the nip is suppressed by using a charge controlling agent (CCA) including quaternary ammonium salt and either nigrosine or triphenyl-methane.

FIGS. 9(A), 9(B), 10(A) and 10(B) are again available to describe the experimental results of the fourth embodiment. These figures show comparisons of blotching generated during experiments when quaternary ammonium salt was and was not used in the CCA.

During these experiments, black fields were printed and their transmission densities compared. Also, white fields were printed, that is, printing was performed based on print data with no black pixels. While printing white fields, toner 53 on the portion of the photosensitive drum 20 that had been subjected to toner development, but that had not yet been subjected to toner transfer, that is, toner 53 indicated at portion W in FIG. 2, was transferred to mending tape and the mending tape was stuck onto a white paper sheet. At the sane time, mending tape with no toner thereon was stuck onto the same white paper sheet. The reflection rate was measured for both tapes and the difference determined. The difference in reflection rate was determined to be the amount of blotching on the photosensitive drum 20.

Here, FIG. 9(A) is a graph showing measurements of transmission density taken when quaternary ammonium salt was used in the CCA. FIG. 9(B) is a graph showing measurements of transmission density taken when quaternary ammonium salt was not used in the CCA. It can be seen in these graphs that the transmission density is lower when quaternary ammonium salt was used in the CCA FIG. 10(A) is a graph showing measurements of botching taken using the above-described method when quaternary ammonium salt was used in the CCA FIG. 10(B) is a graph showing measurements of botching taken using the above-described method transmission density taken when quaternary ammonium salt was not used in the CCA. It can be seen in these graphs that when quaternary ammonium salt was not used in the CCA, electric potential $V_0$ at positions on the photosensitive drum corresponding to white fields decreased from 700 V before development to 450 V after development. Blotching had already started increasing near the developing bias of 300 V.

In contrast to this, when quaternary ammonium salt was used in the CCA, electric potential $V_0$ at positions on the photosensitive drum corresponding to white fields decreased from 700 V to only 600 V. In this way, reduction in electric potential $V_0$ was eased by using quaternary ammonium salt in the CCA, resulting in only the lowest amount of blotching near the developing bias of 300 V.

The fourth embodiment was practiced under the conditions to be described later on. The through rate of the device was set at 6 ppm. The process speed, that is, the peripheral speed of the photosensitive drum 20, was set at 35 mm/sec.

The peripheral speed of the developing roller 56 was set to 70 mm/sec. The peripheral speed of the supply roller 55 was set at 17 to 35 mm/sec. The developing bias was set at 300 V and the surface of the photosensitive drum 20 was charged to an electric potential of 700 V. Further, styrene acrylic toner was used as the toner, The toner includes 0.15% by weight quaternary ammonium salt and 0.2% by weight of nigrosine as the charge controlling agent (CCA) It should be noted that 0.2% by weight of triphenyl-methane could be used instead of nigrosine.

Three aspects of the toner layer on the developing roller 56 were measured: the charge amount per unit of toner by mass Q/M ($\mu$C/g), the mass of toner per unit of surface area M/A (mg/cm$^2$), and the electric potential $V_0$ (V) at the surface of the photosensitive drum 20 corresponding to white fields.

Without quaternary ammonium salt:

| | Before passing through the nip portion | After passing through the nip portion |
|---|---|---|
| Q/M: | 20($\mu$C/g) | 35–40($\mu$C/g) |
| M/A: | 0.5(mg/cm$^2$) | 0.5(mg/cm$^2$) |
| $V_0$ | 700(V) | 450(V) |

With quaternary ammonium salt

| | Before passing through the nip portion | After passing through the nip portion |
|---|---|---|
| Q/M: | 20($\mu$C/g) | 25($\mu$C/g) |
| M/A: | 0.5(mg/cm$^2$) | 0.5(mg/cm$^2$) |
| $V_0$ | 700(V) | 600(V) |

In this way, it could be confirmed that extreme decreases in the electric potential at the surface of the photosensitive drum 20 can be prevented while insuring that the toner 53 will be sufficiently charged by passing through the nip.

Next, a fifth embodiment of the present invention will be described.

According to the fifth embodiment, an additive, such as silica, alumina, or titanium oxide is added to the toner base, wherein the particles of the additive have a diameter of about 30 nm, which is larger than the diameter of the toner base.

Direct contact between the toner base and the surface of the photosensitive drum 20 does not easily occur when the additive particles have a larger diameter than the toner base. As a result, extreme decreases in the electric potential at the surface of the photosensitive drum 20 can be prevented.

The larger the particle diameter of the additive, the less direct contact between the photosensitive drum 20 and the toner base However, when the particle diameter of the additive is too large, then fluidity of the toner 53 decreases so that some of the toner 53 will be insufficiently charged. This results in blotching, that is, undesirable toner spots, at areas subsequent to solid black images.

It is generally believed in the technical field to which the present invention pertains that particles having a diameter of 10 to 20 nm have good fluidity and particles having a diameter of 40 nm or more have poor fluidity. Experiments were performed using silica particles of various sizes. It was determined by these experiments that extreme decreases in the electric potential at the surface of the photosensitive drum 20 could be suppressed by using additive with a particle diameter of about 30 nm or more. Further, it was determined that sufficient fluidity was assured by using additive having particle diameter of 10 to 20 nm or more with the additive having particle diameter of 30 nm or more.

Again, FIGS. 9(A), 9(B), 10(A) and 10(B) are available to describe the experimental results of the fifth embodiment Here, these figures show comparisons of blotching when additives having particle diameter of either less than 30 nm or 30 nm or more was used.

FIG. 9(A) is a graph showing measurements of transmission density taken when additive with particle diameter of 30 nm or more was used. FIG. 9(B) is a graph showing measurements of transmission density taken when additive with particle diameter smaller than 30 nm was used. It can be seen in these graphs that the transmission density is lower when additive with particle diameter of 30 nm or more was used.

FIG. 10(A) is a graph showing measurements of botching taken using the above-described method (wherein toner was transferred to mending tape) when additive with particle diameter of 30 nm or more was used. FIG. 10(B) is a graph showing measurements of blotching taken using the above-described method when additive with particle diameter smaller than 30 nm was used. It can be seen in these graphs that when additive with particle diameter smaller than 30 nm was used, electric potential $V_0$ at positions on the photosensitive drum corresponding to white fields decreased from 700 V before development to 450 V after development. In contrast to this, when additive with particle diameter of 30 nm or more was used, electric potential $V_0$ at positions on the photosensitive drum corresponding to white fields decreased from 700 V to only 600 V. In this ways reduction in electric potential $V_0$ was eased.

The fifth embodiment was practiced under the following conditions. The through rate of the device was set at 6 ppm. The process speed, that is, the peripheral speed of the photosensitive drum 20, was set at 35 mm/sec. The peripheral speed of the developing roller 56 was set to 70 mm/sec. The peripheral speed of the supply roller 55 was set at 17 to 35 mm/sec. The developing bias was set at 300 V and the surface of the photosensitive drum 20 was charged to an electric potential of 700 V. Further, styrene acrylic toner was used as the toner. The toner included 0.20% by weight of nigrosine or 0.20% by weight of triphenyl-methane as the charge controlling agent (CCA).

Three aspects of the toner layer on the developing roller 56 were measured: the charge amount per unit of toner by mass Q/M ($\mu$C/g). the mass of toner per unit of surface area M/A (mg/cm$^2$), and the electric potential $V_0$ (V) at portions corresponding to white fields on the surface of the photosensitive drum 20.

Additive with particle diameter smaller than 30 nm:

| | Before passing through the nip portion | After passing through the nip portion |
|---|---|---|
| Q/M: | 20($\mu$C/g) | 35–40($\mu$C/g) |
| M/A: | 0.5(mg/cm$^2$) | 0.5(mg/cm$^2$) |
| $V_0$ | 700(V) | 450(V) |

Additive with particle diameter of 30 nm or more:

| | Before passing through the nip portion | After passing through the nip portion |
|---|---|---|
| Q/M: | 20(μC/g) | 25(μC/g) |
| M/A: | 0.5(mg/cm$^2$) | 0.5(mg/cm$^2$) |
| $V_0$ | 700(V) | 600(V) |

In this way, it could be confirmed that extreme decreases in the electric potential at the surface of the photosensitive drum 20 can be prevented while insuring that the toner 53 will be sufficiently charged by passing through the nip.

Finally, a sixth embodiment of the present invention will be described.

The six embodiment was made in view of the following observation. Even when the developing agent as described in the foregoing embodiments is used, the toner 53 at some areas of the developing roller 56 can be charged to an excessively high charge amount when passing through the nip, if the developing roller 56 is formed from urethane rubber and the like incorporated with carbon particles. Charge transfer from the photosensitive drum 20 to the toner 53 will be high at these areas, resulting in an excessively low electric potential at the electrostatic latent image on the surface of the photosensitive drum 20.

The reason that toner 53 at some areas of the developing roller 56 is charged to an excessively high charge amount may be that carbon particles exposed at the surface of the developing roller 56 contact the toner 53 and produce an excessive charge amount by friction charging.

According to the sixth embodiment, the developing roller 56 includes a resilient layer and a surface layer provided on the resilient layer. The resilient layer is formed from urethane rubber and the like incorporated with carbon particles. The surface layer is formed from a member formed by adding an ionic material, such as lithium perchlorate or sodium perchlorate to the base urethane rubber so that the member has ionic conductivity. With this configuration, toner 53 can be prevented from directly contacting carbon particles of the developing roller 56. Moreover, because the developing roller 56 has conductivity at its surface layer, localized increases in charge of the toner 53 on the surface of the developing roller 56 can be prevented. Developing performance of the printer can be improved.

Again, FIGS. 10(A) and 10(B) are available to describe the experimental results of the sixth embodiment. Here, FIGS. 10(A) and 10(B) show a comparison of blotching generated when the developing roller 56 includes and does not include a surface layer formed from a member having ionic conductivity.

Experiments that produced the results shown in FIGS. 10(A) and 10(B) were performed using the following method. White fields were printed, that is, printing was performed based on print data with no black pixels. While printing white fields, toner 53 on the portion of the photosensitive drum 20 that had been subjected to toner development, but had not yet been subjected to toner transfer, that is, toner 53 indicated at portion W in FIG. 2, was transferred to mending tape and the mending tape was stuck onto a white paper sheet. At the same time, mending tape with no toner thereon was stuck onto the same white paper sheet. The reflection rate was measured for both tapes and the difference determined. The difference in reflection rate was determined to be the amount of blotching on the photosensitive drum 20.

FIG. 10(A) is a graph showing measurements of botching taken using the above-described method when the above-described surface layer was provided to the developing roller 56. FIG. 10(B) is a graph showing measurements of localized blotching taken using the above-described method when the above-described surface layer was not provided to the developing roller 56. It can be seen in these graphs that when the above-described surface layer was not provided to the developing roller 56, electric potential $V_0$ at positions on the photosensitive drum corresponding to white fields was measured to decrease locally from 700 V before development to 250 V after development In contrast to this, when the above-described surface layer was provided to the developing roller 56, electric potential $V_0$ at all positions on the photosensitive drum decreased from 700 V to only 600 V. In this way, it was determined that localized reduction in electric potential $V_0$ was eased.

The sixth embodiment was practiced under the following conditions. The through rate of the device was set at 6 ppm. The process speed, that is, the peripheral speed of the photosensitive drum 20, was set at 35 mm/sec. The peripheral speed of the developing roller 56 was set to 70 mm/sec. The peripheral speed of the supply roller 55 was set at 17 to 35 mm/sec. The developing bias was set at 300 V and the surface of the photosensitive drum 20 was charged to an electric potential of 700 V. Further, styrene acrylic toner was used as the toner. The toner included 0.20% by weight of nigrosine as the charge controlling agent (CCA).

Three aspects of the toner layer on the developing roller 56 were measured: the charge amount per unit of toner by mass Q/M (μC/g). the mass of toner per unit of surface area M/A (mg/cm$^2$), and the electric potential $V_0$ (V) at portions corresponding to white fields on the surface of the photosensitive drum 20.

Surface layer was provided to developing roller:

| | Before passing through the nip portion | After passing through the nip portion |
|---|---|---|
| Q/M: | 20(μC/g) | 25(μC/g) |
| M/A: | 0.5(mg/cm$^2$) | 0.5(mg/cm$^2$) |
| $V_0$ | 700(V) | 600(V) |

In this way, it could be confirmed that extreme decreases in the electric potential at the surface of the photosensitive drum 20 can be prevented while insuring that the toner 53 will be sufficiently charged by passing through the nip.

With the various embodiments described above, when the rotational directions of the photosensitive drum 20 and the developing roller 56 are opposite of each other, toner 53 can be properly circulated and image development can be properly performed over long periods of time.

However, the photosensitive drum 20 and the developing roller 56 are rotated in the opposite directions, little toner 53 will remain at the nip portion between the photosensitive drum 20 and the developing roller 56 when development rate is near 100%. In other words, when a sheet is printed completely black, wave shaped white portion can appear in the middle of the black region.

It was determined that by using a developing agent having a charge series as described above wave shaped white portions are almost never generated in even after a sheet is printed completely black.

Although the reasons for this occurring are unclear, no wave shaped white portions were confirmed when printing sheets completely black using the device of the present embodiments.

In this way, not only thin lines and independent dots can be properly reproduced, wave shaped white portions can be prevented from appearing and sheets that printed all black so that a good printed image can be obtained.

Operations of the laser beam printer 1 will be described while referring to the drawings. It should be noted that the laser beam printer 1 forms images using reverse development type developing processes.

Figure 5:
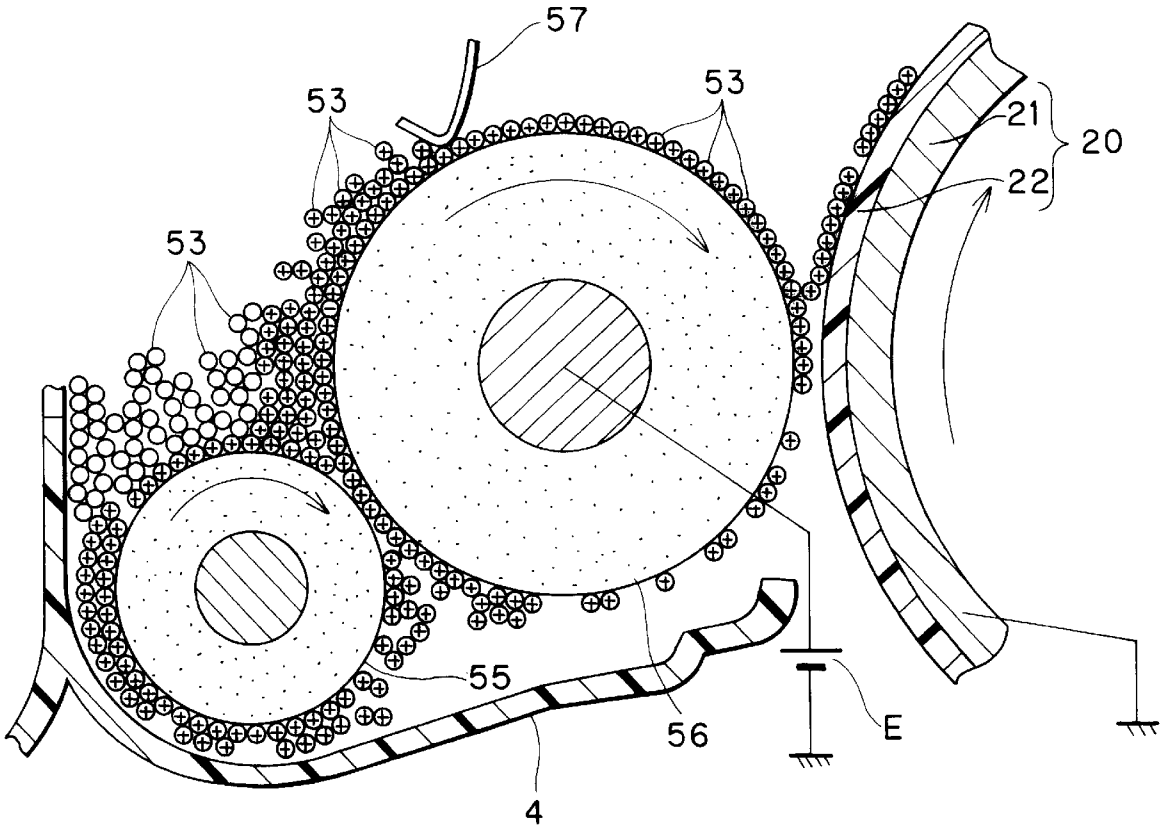
FIG. 5 is an enlarged view in partial cross-section showing the developing unit of the laser beam printer of FIGS. 1(A) and 1(B)
Figure 6:
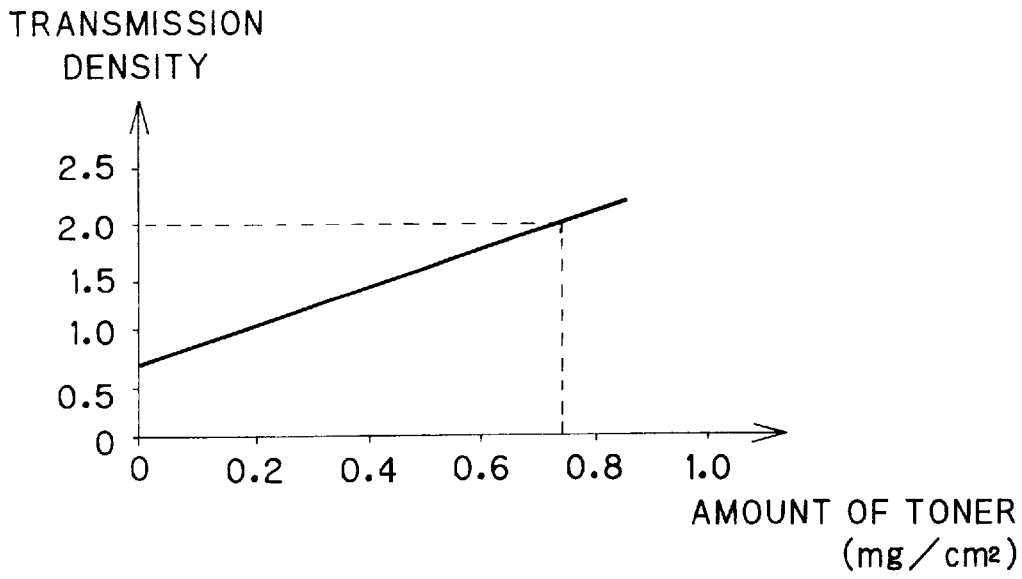
FIG. 6 is a graphical representation of the relationship between development toner amount and transmission density in the laser bean printer of FIG. 1(A)

As shown in FIG. 1(A) or 1(B), the photosensitive drum is driven to rotate in the clockwise direction by a drive means. The supply roller 55 and the developing roller 56 are both driven to rotate clockwise. As shown in FIG. 5, each particle of toner 53 is charged to a positive polarity, that is, charge amount Q1, by rubbing against the supply roller 55 and the developing roller 56 or by pressing friction of the layer regulating blade 57 against the developing roller 56. The toner 53 charged to the positive polarity is rubbed by the developing roller 56 and the photosensitive drum 20 at the nip portion between the developing roller 56 and the photosensitive drum 20. As a result, toner 53 is charged with a charge amount Q2, which is greater than the charge amount Q1. Further, toner 53 clings to the electrostatic latent image formed on the photosensitive drum 20 using laser light L. In this way, the electrostatic latent image is developed using reverse development techniques.

The layer regulating blade 57 forms a toner layer on the developing roller 56 wherein the toner layer has the toner amount equal to or less than 0.5 mg/cm$^2$. Accordingly, the layer of toner 53 on the developing roller 56 has a thickness of one or slightly one particle, of toner. Therefore, most of the toner used are properly rubbed by the developing roller 56 and the layer regulating blade 57. The toner 53 is charged to a predetermined charge amount Q1 which is less than a saturated charging amount of the toner.

An image density, that is, transmission density, of about two is required for an image to be formed on a sheet P. In order to obtain image density of two, then as shown in FIG. 5, toner needs to cling to the sheet P in a developing toner amount of about 0.78 mg/cm$^2$. This developing toner amount can be obtained by using the layer regulating blade 57 to regulate an amount of toner on the developing roller 56 to about 0.4 mg/cm$^2$ and also by setting the developing rate to slightly less than 100% and setting the peripheral speed of the developing roller 56 to about double the peripheral speed of the photosensitive drum 20. In other words, the toner 53 is retained on the developing roller 56 in small amounts by Van der Waals forces to prevent the developing roller 56 and the photosensitive drum 20 from directly contacting each other at the nip portions therebetween. The toner 53 remaining on the developing roller 56 serves as a lubricant between the developing roller 56 and the photosensitive drum 20.

The charge amount of the toner 53 can very depending on the ambient temperature and humidity. For example, the charge amount of the toner 53 can very from about 25 $\mu$C/g in a low temperature, low humidity environment of 10° C. and 20% humidity to about 20 $\mu$C/g in a high temperature, high humidity environment of 32° C. and 80% humidity. When the developing roller 56 is driven to rotate in the same direction as the photosensitive drum 20, the actual developing bias voltage of the developing roller 56 is set to about 200 V as shown in FIG. 7 to obtain a predetermined developing toner amount of about 0.78 mg/cm$^2$ during low temperature, low humidity environment indicated by a single dot chain line of FIG. 7 and high temperature, high humidity environment indicated by a double dot chain line in FIG. 7. At the same time, because of the voltage of the electrostatic latent image formed on the photosensitive drum 20 is about 100 V, the developing bias voltage of a developing power source E for applying voltage to the developing roller 56 is set to about 300 V.

Figure 8:
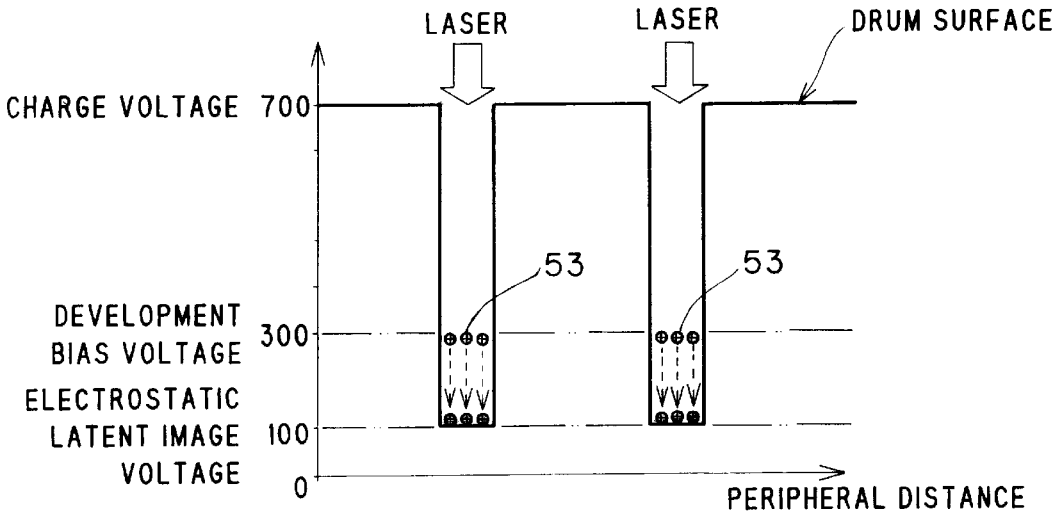
FIG. 8 is an explanatory diagram showing electric potential at exposed and unexposed portions of the photosensitive drum during reverse development performed by the laser beam printer of FIG. 1(A)

When image forming processes are started at voltages set as described above, first residual charge on the surface of the photosensitive drum 20 is cleaned off using the charge removing lamp 41. Next, the charge unit 40 charges the surface of the photosensitive drum 20 to a uniform positive charge of, for example, about +700V as shown in FIG. 8. In this condition, the laser generating unit 31 emits laser light L. The laser light L is reflected off and scanned in the main scanning direction by the polygon mirror 32 and passes through the lenses 33, 34 and the reflection mirrors 35, 36 before irradiating the surface of the photosensitive drum 20. As a result, electrostatic latent images are formed on the surface of the photosensitive drum 20. At this time, the laser light L reduces voltage of portions corresponding to the electrostatic latent image on the photosensitive drum 20 to, for example, about +100 V as shown in FIG. 8. The surface of the developing roller 56 is applied with a developing bias voltage of, for example, about +300 V as shown in FIG. 8 so that positively charged toner 53 clings to the surface of the developing roller 56 in a layer about one or slightly more particle thick. Therefore, the toner 53 is drawn toward the electrostatic latent image which has a lower voltage of about 100 V than other regions at the surface of the photosensitive drum 20, which has been charged to about +700 V In other words, the toner 53 is not drawn toward unirradiated regions of the photosensitive drum 20, which have a high voltage of about +700 V. In this way, the toner 53 from the developing roller 56 clings to and develops the electrostatic latent image formed on the photosensitive drum 20.

As a result of this theory, the electric potential of single dot is sufficiently reduced so that as shown in FIG. 4(B), image development can be properly performed.

The toner image resulting from developing the electrostatic latent image using the toner 53 is transferred by the transfer roller 60 to a sheet P. Afterward, the sheet P is subjected to fixing processes by the fixing unit 70 and discharged onto the discharge tray 77.

The transport pathway PP on which sheets P are transported from the sheet feed cassette 14 is formed in an approximately straight line. Therefore, sheets P are formed with images while transported along the linear transport pathway PP. As a result, images can be accurately and cleanly formed on the sheet P even whether the sheet P is thick paper objects, such as a postcard or an envelope, or a overhead projector film.

On the other hands, as shown in FIG. 1(A), residual toner 53 which does not transferred to the sheet P while passing by the transfer roller 60 and which remains on the photosensitive drum 20 is temporarily absorbed onto the cleaning roller 42 by charging the bias voltage of the cleaning roller 42 in the manner described previously. Next, at a timing which does not interfere with exposure, development, or transfer operations for the next image to be formed on the photosensitive drum 20, the bias voltage of the cleaning roller 42 is again changed to discharge absorbed toner from the cleaning roller 42 onto the photosensitive drum 20. Further, residual toner on the photosensitive drum 20 is collected by the developing roller 56.

In parallel with these toner collection operations, toner 53 on the developing roller 56 before image development is charged to the charge amount Q2 when rubbed at the nip portion and also clings to the exposed portions of the photosensitive drum 20 so that development can be correctly performed.

Although the present invention has been described with respect to specific embodiments, it will be appreciated by one skilled in the art that a variety of changes may be made without departing from the scope of the invention. For example, certain features may be used independently of others and equivalents may be substituted all within the spirit and scope of the invention.

Although only monochrome image formation was described above, the present invention can be effectively used for color image formation. Further, although the developing roller 56 and the photosensitive drum 20 were described as moving in the same rotational direction so that their contacting surfaces are moving in the opposite directions, the developing roller 56 and the photosensitive drum 20 can be driven to rotate in opposite directions so that their contacting surfaces move in the same direction. Although the photosensitive drum was described as an example of a photosensitive body, the photosensitive body can be a belt shaped photosensitive body while still achieving the same benefit of the present invention Although the embodiments are directed to the laser beam printer, the present invention can be applied to any electrophotographic image forming device, such as a copy machine, a facsimile machine, and the like.

What is claimed is:

1. An image forming device comprising:

a photosensitive member;

an electrostatic latent image forming unit that forms an electrostatic latent image on said photosensitive member while said photosensitive member is moving;

a developing agent bearing member that bears and transports a developing agent onto said photosensitive member, said developing agent bearing member contacting said photosensitive member at a nip portion between said developing agent bearing member and said photosensitive member, said developing agent bearing member performing image development to develop at the nip portion the electrostatic latent image on said photosensitive member into a visible image using the developing agent, the developing agent being formed from a material that, when said image development is performed by said developing agent bearing member, is charged by friction at the nip portion to a greater charge amount after passing through the nip portion than before arriving at the nip portion.

2. The image forming device according to claim 1, wherein said photosensitive member has a surface portion formed from a positively chargeable organic material, and the developing agent includes a positively chargeable toner and a charge controlling agent for controlling a positive charge of the toner.

3. The image forming device according to claim 2, wherein the developing agent comprises styrene acrylic toner as the positively chargeable toner and nigrosine as the charge controlling agent.

4. The image forming device according to claim 2, wherein the developing agent comprises styrene acrylic toner as the positively chargeable toner and triphenylmethane as the charge controlling agent.

5. The image forming device according to claim 1, wherein said developing agent bearing member transports the developing agent opposite a direction in which said photosensitive member moves at the nip portion.

6. The image forming device according to claim 1, further comprising an urging force adjusting member that adjusts an urging force of said developing agent bearing member against said photosensitive member.

7. The image forming device according to claim 6, wherein said urging force adjusting member adjusts the urging force to 700 gf or less when said developing agent bearing member and said photosensitive member are held stationary.

8. The image forming device according to claim 7, wherein said developing agent bearing member has a resilient layer formed from silicone.

9. The image forming device according to claim 7, wherein said developing agent bearing member has a resilient layer formed from urethane.

10. The image forming device according to claim 7, wherein the developing agent comprises styrene acrylic toner and a charge controlling agent that comprises nigrosine.

11. The image forming device according to claim 7, wherein the developing agent comprises styrene acrylic toner and a charge controlling agent that comprises triphenyl-methane.

12. The image forming device according to claim 7, wherein an amount of a toner and an amount of a charge controlling agent are mixed at a predetermined ratio to form the developing agent.

13. The image forming device according to claim 7, wherein said developing agent bearing member transports the developing agent opposite a direction In which said photosensitive member moves at the nip portion.

14. The image forming device according to claim 1, further comprising a deformation amount regulating member that regulates a deformation amount of said developing agent bearing member under a condition where said developing agent bearing member is brought into urgingly contact with said photosensitive member, said deformation amount regulating member regulating the deformation amount to 100 $\mu$m or less.

15. The image forming device according to claim 14, wherein said developing agent bearing member has a resilient layer formed from silicone.

16. The image forming device according to claim 14, wherein said developing agent bearing member has a resilient layer formed from urethane.

17. The image forming device according to claim 14, wherein a developing agent comprises styrene acrylic toner and the charge controlling agent comprises nigrosine.

18. The image forming device according to claim 14, wherein the developing agent comprises styrene acrylic toner and a charge controlling agent that comprises triphenyl-methane.

19. The image forming device according to claim 14, wherein an amount of a toner and an amount of a charge controlling agent are mixed at a predetermined ratio to form the developing agent.

20. The image forming device according to claim 14, wherein said developing agent bearing member transports the developing agent opposite a direction in which said photosensitive member moves at the nip portion.

21. The image forming device according to claim 14, wherein said developing agent bearing member is in a form of a roller having a diameter and a shaft with two ends, said deformation amount regulating member is coaxially provided to at least one of the two ends of said developing agent bearing member, and said deformation amount regulation member has a diameter equal to or smaller than the diameter of said developing agent bearing member.

22. An image forming device comprising:

a photosensitive member having a surface portion formed from a positively chargeable organic material;

an electrostatic latent image forming unit that forms an electrostatic latent image on said photosensitive member while said photosensitive member is moving; and a developing agent bearing member that bears and transports a developing agent onto said photosensitive member, said developing agent bearing member contacting said photosensitive member at a nip portion between said developing agent bearing member and said photosensitive member, said developing agent bearing member performing image development to develop at the nip portion the electrostatic latent image on said photosensitive member into a visible image using the developing agent, wherein the developing agent comprises styrene acrylic toner and a charge controlling agent that includes quaternary ammonium salt and at least one of triphenyl-methane and nigrosine.

23. The image forming device according to claim 22, wherein a mixture ratio of an amount of the toner to an amount of the charge controlling agent is determined so that when said image development is performed by said developing agent bearing member, the toner is charged by friction at the nip portion to a greater charge amount after said image development than before said image development.

24. The image forming device according to claim 22, wherein said developing agent bearing member transports the developing agent opposite a direction in which said photosensitive member moves at the nip portion.

25. An image forming device comprising:

a photosensitive member having a surface portion formed from a positively chargeable organic material;

an electrostatic latent image forming unit that forms an electrostatic latent image on said photosensitive member while said photosensitive member is moving; and a developing agent bearing member that bears and transports a developing agent onto said photosensitive member, said developing agent bearing member contacting said photosensitive member at a nip portion between said developing agent bearing member and said photosensitive member, said developing agent bearing member performing image development to develop at the nip portion the electrostatic latent image on said photosensitive member into a visible image using the developing agent, wherein the developing agent comprises a positively chargeable toner, a charge controlling agent that controls a positive polarity on the toner, and an additive particle having a diameter of 30 nm or more.

26. The image forming device according to claim 25, wherein the developing agent includes styrene acrylic toner as the positively chargeable toner, and at least one of triphenyl-methane and nigrosine as the charge controlling agent.

27. The image forming device according to claim 25, wherein a mixture ratio of an amount of the toner, an amount of the charge controlling agent and an amount of the additive particle and also the diameter of the additive particle are determined so that when said image development is performed by said developing agent bearing member, the toner is charged by friction at the nip portion to a greater charge amount after said image development than before image development.

28. The image forming device according to claim 25, wherein said developing agent bearing member transports the developing agent opposite a direction in which said photosensitive member moves at the nip portion.

29. An image forming device comprising:

a photosensitive member having a surface portion formed from a positively chargeable organic material;

an electrostatic latent image forming unit that forms an electrostatic latent image on said photosensitive member while said photosensitive member is moving; and a developing agent bearing member having a surface layer for bearing and transporting a developing agent onto said photosensitive member, at least the surface layer of said developing agent bearing member being formed from a material having an ionic conductivity, said developing agent bearing member contacting said photosensitive member at a nip portion between said developing agent bearing member and said photosensitive member, said developing agent bearing member performing image development to develop at the nip portion the electrostatic latent image on said photosensitive member into a visible image using the developing agent, wherein the developing agent comprises a positively chargeable toner and a charge controlling agent that controls a positive polarity on the toner.

30. The image forming device according to claim 29, wherein the surface layer is formed from lithium perchlorate.

31. The image forming device according to claim 29, wherein the surface layer is formed from sodium perchlorate.

32. The image forming device according to claim 29, wherein the developing agent includes styrene acrylic toner as the positively chargeable toner, and at least one of triphenyl-methane and nigrosine as the charge controlling agent.

33. The image forming device according to claim 29, wherein a mixture ratio of an amount of the toner to an amount of the charge controlling agent and also the ionic conductivity of the material forming the surface layer are determined so that when said image development is performed by said developing agent bearing member, the toner is charged by friction at the nip portion to a greater charge amount after said image development than before said image development.

34. The image forming device according to claim 29, wherein said developing agent bearing member transports the developing agent opposite a direction in which said photosensitive member moves at the nip portion.

35. A process cartridge comprising:

a photosensitive member on which an electrostatic latent image is formed while the photosensitive member is moving; and a developing agent bearing member that bears and transports a developing agent onto said photosensitive member, said developing agent bearing member contacting said photosensitive member at a nip portion between said developing agent bearing member and said photosensitive member, said developing agent bearing member performing image development to develop at the nip portion the electrostatic latent image on said photosensitive member into a visible image using the developing agent, the developing agent being formed from a material that, when said image development is performed by said developing agent bearing member, is charged by friction at the nip portion to a greater charge amount after passing through the nip portion than before arriving at the nip portion.

36. The process cartridge according to claim 35, wherein said photosensitive member has a surface portion formed from a positively chargeable organic material, and the developing agent includes a positively chargeable toner anda charge controlling agent for controlling a positive charge of the toner.

37. The process cartridge according to claim 36, wherein the developing agent comprises styrene acrylic toner as the positively chargeable toner and nigrosine as the charge controlling agent.

38. The process cartridge according to claim 36, wherein the developing agent comprises styrene acrylic toner as the positively chargeable toner and triphenyl-methane as the charge controlling agent.

* * * * *